United States Patent [19]

Johnson

[11] 4,219,087

[45] Aug. 26, 1980

[54] ENLARGED BORE HOLE DRILLING METHOD

[75] Inventor: Gary R. Johnson, Yorba Linda, Calif.

[73] Assignee: Tri State Oil Tool Industries, Inc., Bossier City, La.

[21] Appl. No.: 4,403

[22] Filed: Jan. 18, 1979

Related U.S. Application Data

[62] Division of Ser. No. 854,132, Nov. 23, 1977.

[51] Int. Cl.[2] ..... E21C 7/06

[52] U.S. Cl. ..... 175/65; 175/213; 175/215; 175/267

[58] Field of Search ..... 175/65, 71, 213, 267, 175/269, 217, 215, 286, 288, 271

[56] References Cited

U.S. PATENT DOCUMENTS

| | | | |
|---|---|---|---|
| 2,697,586 | 12/1954 | Talley | 175/288 X |
| 2,849,213 | 8/1958 | Failing | 175/215 |
| 3,196,960 | 7/1965 | Kammerer | 175/267 |
| 3,528,516 | 9/1970 | Brown | 175/267 |
| 3,730,592 | 5/1973 | Wenneborg et al. | 175/213 |
| 3,747,696 | 7/1973 | Wenneborg et al. | 175/215 X |
| 3,757,877 | 9/1973 | Leathers | 175/269 |

*Primary Examiner*—Ernest R. Purser
*Assistant Examiner*—Richard E. Favreau
*Attorney, Agent, or Firm*—Subkow and Kriegel

[57] ABSTRACT

The method is disclosed for drilling a pilot hole and subsequently enlarging the pilot hole in earth formation. A dual concentric pipe string is used for circulating air downwardly through the outer pipe, through a pilot bit and upwardly through the bore hole outside the pipe string to bail cuttings, during drilling of the pilot hole. The air pressure expands the cutters of an expansible bit while a milited portion of the air supplied cools the cutters. After the cutters are fully expanded, additional air is utilized to clean and cool the cutters. Air is returned through the inner pipe of the dual concentric pipe string. A venturi device is utilized to induce return flow through the inner pipe during enlargement of the hole and to vacuum residue when enlargement is completed. The dual concentric pipe string is made up of lengths of pipe providing threaded, sealed joints.

8 Claims, 26 Drawing Figures

17
25
23
22
S
55'
51
38
56
52
53
29
50
46
51'
28
48
54
49
20
40
39
55
44
4
4
45
43
42
10
66
41
65
58
21
61
64
57
59
47
60
31
62
30
63
67
68

199
184
154
183
161
162
163
160
164
13
13
186
167
185
186
166
177
179
EB
171
172
196
173
197
178
182
14
14
191
180
193
168
181
194
16a
169
195
16
188
192
16d
16c
170
188
187
189
190
16b
181a
222
C

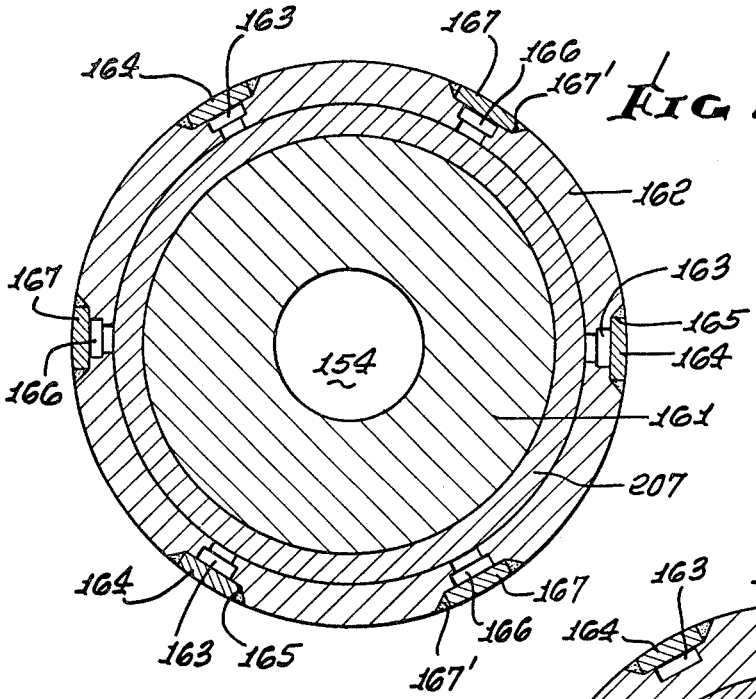
FIG. 12.
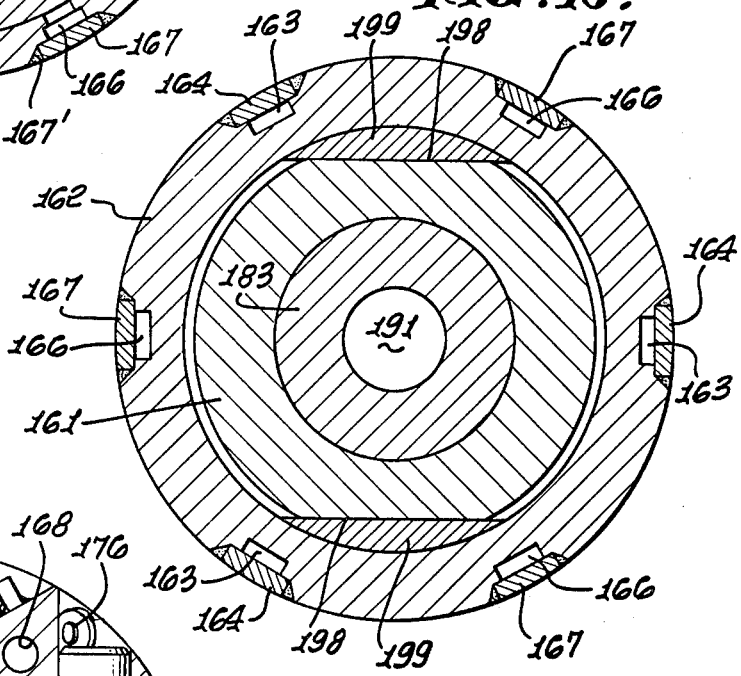
FIG. 13.
FIG. 14.
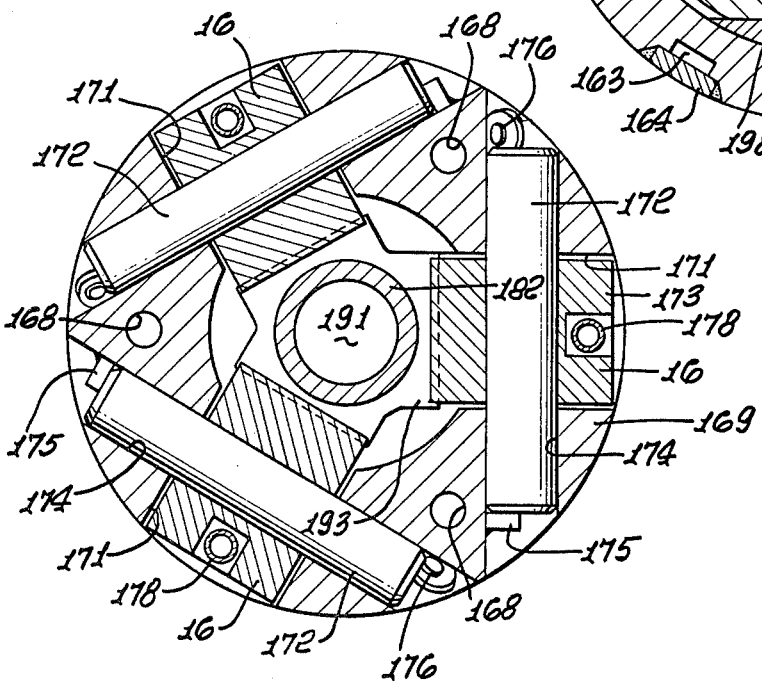

199
184
154
183
161
166
163

167
186
185
160
164
177
EB
171
172
179
168
173
197
178
180
194
182
196
181
191
195
193
16a
169
16
EH
189
190
187
16c
16d
170
188
16b
192
181a
C
222
PH

ENLARGED BORE HOLE DRILLING METHOD

CROSS REFERENCE TO RELATED APPLICATION

This application is a division of my pending application Ser. No. 854,132, filed Nov. 23, 1977.

In the forming of bore holes in the earth, more particularly enlarged bore holes, for example, blast holes used in bench mining or quarrying, it has become the practice to drill a pilot hole to a given depth and enlarge the hole to form a large chamber for receiving a blasting explosive. Such bore holes are also useful in connection with in-situ fragmentation for chemical mining and coal gasification techniques. In the drilling of other bore holes into or through the earth, such as oil or gas wells, it is sometimes necessary or desirable to enlarge the well bore for a given distance.

Accordingly, hole openers, including expansible drill bits have evolved. Some of the expansible drill bits have included a pilot bit in combination with expansible cutters to drill a pilot hole and also drill out an enlarged chamber. When drilling with liquid or mud as a drilling fluid to cool the cutters and flush cuttings from the bore hole, it is customary to circulate the drilling fluid down a length of drill pipe or tubular conduit, and the fluid returns through the annulus between the pipe and the bore hole to flush cuttings from the hole.

In the case of certain bore hole drilling operations, both in the formation of blast holes and other bore holes, air or gas is employed as the drilling fluid to cool the cutters and remove the cuttings from the bore hole. However the effective removal of cuttings by air requires a relatively high bailing velocity as compared with liquid drilling fluids. According to most authorities, air bailing velocities on the order of five thousand feet per minute of air are required.

When large bore holes are being drilled, using air as a drilling fluid, therefore, it will be appreciated that such bailing velocity of the air through the annulus, outside the drill pipe may be difficult to accomplish or may require compressor capacity at the drilling rig in excess of that available or economically practical to obtain. Moreover, even if added compressors can supply sufficient air to cause the effective bailing of cuttings through the bore hole annulus, the velocity of air returning to the reduced annular space above the enlarged chamber or bore hole would be objectionably noisy at the outlet, and the abrasive nature of the cuttings and dust would be damaging to the drill pipe and the integrity of the enlarged bore hole. In the case of blast holes, particularly, erosion of the shoulder at the beginning of the enlarged chamber is undesirable in that the blasting effectiveness is reduced.

So called reverse circulation of drilling fluid has been resorted to in an effort to supply drilling fluid at adequate bailing velocity. The reverse circulation involves circulating air downwardly through the bore hole annulus and upwardly through the bit and drill pipe, the velocity in the relatively small bore of the pipe being quite high due to the small cross-sectional area of the flow passage.

In addition, circulation of the drilling fluid through so-called dual concentric pipe strings has been resorted to in some drilling operations. Dual concentric pipe strings involve providing concentric inner and outer pipes having connections which provide flow passages establishing communication with the annular space between the pipe sections, as well as through the central pipe bore. However, providing a good seal at the pipe connections and adequate wrench areas or tool slots for making up and breaking out the connections, while maintaining adequate flow area, are problems in dual concentric drill pipe.

When expansible, pivoted cutter supporting arms on drill bits are actuated outwardly by air pressure to initiate an enlarged bore hole, the flow of air to the cutters, in air cooled cutter bits, may be so great that inadequate pressure is present to effect expansion of the cutters in a reasonably short period of drilling, so that a long tapered side wall is formed on which the back or outer surfaces of the pivoted cutter arms may drag and wear. Thus, it is desirable that the expensive force be maintained on the arms which carry the cutters, while not depriving the cutters of sufficient cooling air during the early stages of bore hole enlargement.

Air cooled expansible cutters currently available are both complicated in the structure permitting the flow of air through the cutter support arms and inefficient in terms of the cleaning and cooling effect of the air on the cutter elements.

In the formation of blast holes in mining or quarrying operations, it has been found that a two-pass method of first drilling a pilot hole with a first drill bit and drill string, and then, in a second pass, enlarging the hole with an expansible bit run on a second drill string, produces a superior blast hole shape, if the bore hole enlargement is continued substantially to the bottom of the pilot hole. Since the annular bore hole space outside the drill string, when drilling the pilot hole is not large in cross-sectional flow area, the drilling fluid or air can be normally circulated down the drill string and up the annulus, and the bailing velocity of the fluid or air in the annulus may be adequate. Thereafter, however, when the second, hole enlarging pass is being made, the enlargement of the bore hole may so increase the annular flow area that the necessary air bailing velocity may not be obtained with existing compressors. If an expansible bit is used which is expanded by reverse circulation, even through a dual concentric pipe string, a different set up of equipment at the rig is necessary to supply the air through the annulus. On the other hand, the pilot bit could not be used on the dual pipe with the dual pipe rig equipment which supplies air through the dual pipe annulus. Thus, two separate pipe strings for the pilot drilling pass and the enlarging drilling pass would be required in the case of existing equipment.

When forming blast holes by the two-pass method to provide a more-or-less flat bottomed enlarged chamber, as more particularly disclosed in the pending application for United States Patent, Ser. No. 726,947, filed Sept. 27, 1976, it is desirable that the bottom of the hole be relatively free from cuttings and accumulated dust at the conclusion of the drilling. Accumulated debris at the bottom of the hole can cushion the explosive effect and interfere with bench removal or effective fragmentation. However, residual cuttings and dust in the hole have continued to be a problem.

The present invention relates to improved reverse circulation, pilot hole and enlarged hole drilling which obviates the problems referred to above.

More particularly, the present invention provides for forming enlarged bore holes or blast holes utilizing a two-pass method and reverse circulation through a dual concentric pipe string during the bore hole enlargement drilling, the dual concentric pipe string also being utilized during the drilling of the pilot hole.

A dual concentric pipe string is provided, according to the invention, made up in lengths of pipe having threaded pin and box ends providing sealed connections or joints between the lengths of pipe. One length of pipe utilized in the pipe string during drilling of the pilot hole has a cross-over structure which blanks off the center pipe above the pilot bit and allows air flow from between the center and outer pipes to the air passage of the pilot bit, so that return flow of air is upwardly in the annulus between the pipe string and the bore hole wall. A sealed swivel structure provides for the supply of air to the space between the center pipe and the outer pipe, from a source of drilling air, and includes a rotary mandrel connected to the pipe string by one of the sealed dual pipe joints.

Also, in accordance with the invention, the expansible bit for enlarging the bore hole has a piston and cylinder structure to which air is supplied from the space between the center and outer pipes for effecting outward expansion of cutter arms in response to longitudinal movement of an outer arm support with respect to an inner body and rotary drive mandrel for the arm support. During initial movement of the arm support and expansion of the cutter arms, a relatively small amount of the total air pressure is allowed to be bled off from the piston and cylinder structure and to flow through passages in the arm supports and to the cutters to cool the cutters; while the greater portion of the air pressure is maintained in the piston and cylinder structure to effect expansion of the cutters. When the cutters are in fully expanded condition, they are mechanically locked expanded and additional passage means are opened to allow a greater volume of the air to pass through the piston and cylinder means and flow through the cutters. Still further passage means in the cutter support are also opened to allow air from the piston and cylinder structure to flow through the outer cutter support body to nozzles which are directed towards the cutters, to blow cutting therefrom and assist in cooling the cutters, while the cutters are fully expanded and mechanically locked in the expanded condition.

A simple structure is provided for conducting air from the piston and cylinder structure to the cutters, through the cutter support body and arms. The arms have fluid passages connected with additional passages in the support body by a flexible connector conduits enabling pivotal movement of the arms. The passages in the arms lead to bearing supports for roller cutters revolvable on the supports, and the air flows through the bearings and bearing races.

In order to assure adequate return air flow through the center pipe during the enlargement of the bore hole, means are provided to induce such return air flow. More particularly, venturi means are associated with the discharge line or conduit from the top drive unit which rotates the drill pipe. The venturi means has an air inlet to which air can be supplied independently of the air supplied to the pipe string. Thus, effective bailing or removal of cuttings is assured. In addition, the venturi means is preferably capable of inducing continued air flow through the center pipe to remove residual cuttings and dust which settle in the hole when the drilling of the enlargement is complete. Such residual material can be agitated by continued rotation of the expanded cutters, but without applying thrust to the drill pipe.

This invention more particularly involves the method of drilling enlarged bore holes in earth formation comprising: drilling a pilot hole into the earth formation by rotating a pilot bit on a dual pipe string having an outer fluid path defined between inner and outer pipes, while circulating through the bit and causing drilling fluid and cuttings to flow from the pilot hole through the space between the pipe string and the wall; halting the circulation of drilling fluid and removing the pipe string and pilot bit from the bore hole; replacing the pilot bit with a bore hole enlarging bit having cutters expansible to a gauge in excess of the guage of the pilot bit; moving the enlarging bit on the drill pipe to a selected location in the pilot hole; expanding said enlarging bit cutters by supplying drilling fluid through said outer fluid path of said drill pipe to said drill pipe to said enlarging bit; rotating said drill pipe and enlarging bit to drill the enlarged bore hole while removing a portion of the drilling fluid and cuttings of earth formation through an inner fluid path defined by said inner pipe; ceasing the supply of drilling fluid; retracting the enlarging bit cutters; and removing said drill pipe and enlarging bit form the enlarged bore hole.

This invention possesses many other advantages and has other purposes which may be made more clearly apparent from a consideration of a method for practicing the invention. The method is described in the present specification in connection with the drawings accompanying and constituting a part thereof. Such method will now be described in deatil, for the purpose of illustrating the general principles of the invention; but it is to be understood that such detailed description is not to be taken in a limiting sense.

Referring to the drawings:

FIGS. 1*a* and 1*b*, together, constitute a view diagrammatically showing the drilling of a pilot bore hole into earth formation, utilizing the dual drill pipe string of the invention, FIG. 1*b* being a downward continuation of FIG. 1*a;*

FIGS. 2*a* and 2*b*, together, constitute a view diagrammatically showing the enlargement of the pilot bore hole of FIGS. 1*a* and 1*b* utilizing the expansible bit of the invention and reverse circulation through the dual pipe string, FIG. 2*b* being a downward continuation of FIG. 2*a.*

FIGS. 3*a* and 3*b*, together, constitute an enlarged longitudinal section through the swivel structure, FIG. 3*b* being a downward continuation of FIG. 3*a;*

FIG. 3*c* is a fragmentary vertical section on the line 3*c*—3*c* of FIG. 3*b;*

FIG. 4 is a transverse section through the swivel, as taken on the line 4—4 of FIG. 3*a;*

FIGS. 5*a* and 5*b*, together, constitute an enlarged vertical section, as taken on the line 5—5 of FIG. 1, showing a typical dual pipe joint, FIG. 5*b* being a downward continuation of FIG. 5*a;*

Figure 8A:
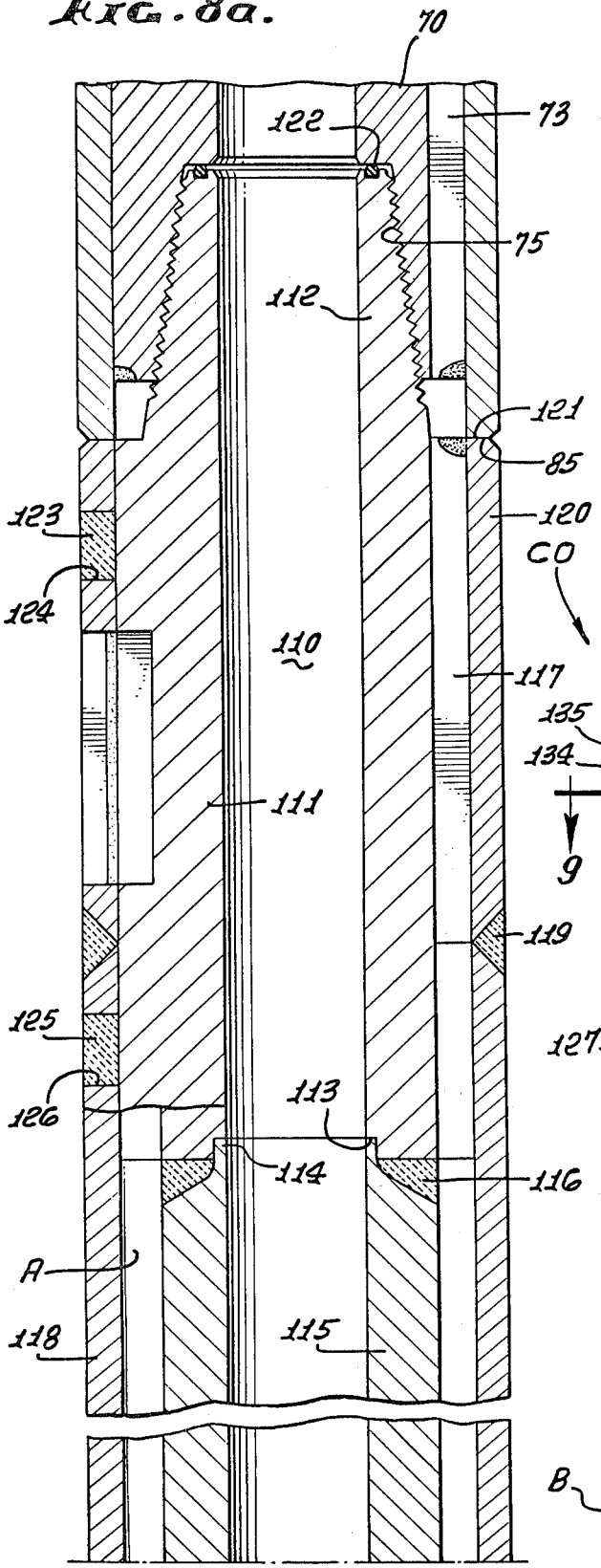
Figure 8B:
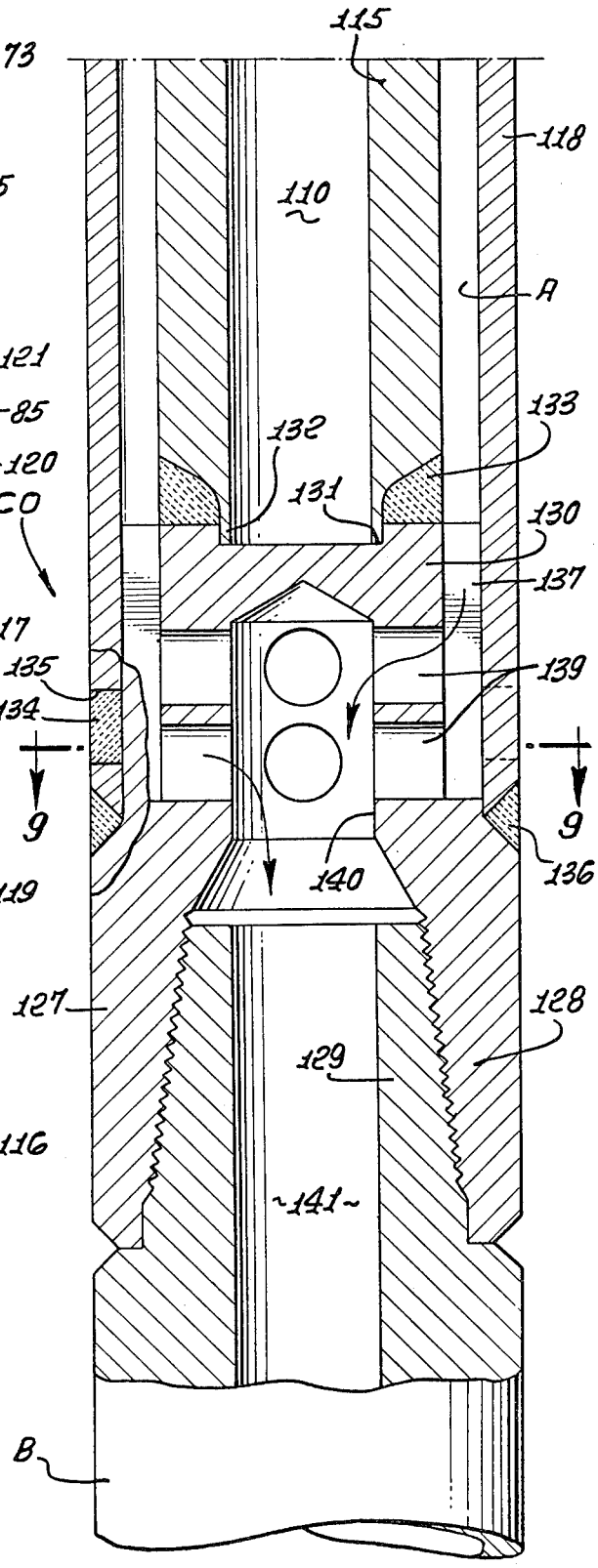

FIGS. 8*a* and 8*b*, together, constitute an enlarged vertical section, as taken on the line 8—8 of FIG. 1, showing the crossover unit in the dual pipe string used to drill the pilot bore hole; FIG. 8*b* being a downward continuation of FIG. 8*a;*

Figure 9:
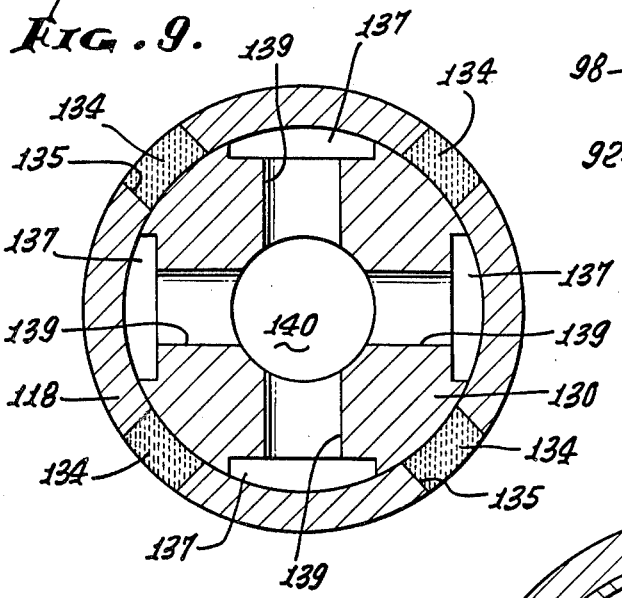

FIG. 9 is a transverse section as taken on the line 9—9 of FIG. 8*b;*

Figure 10A:
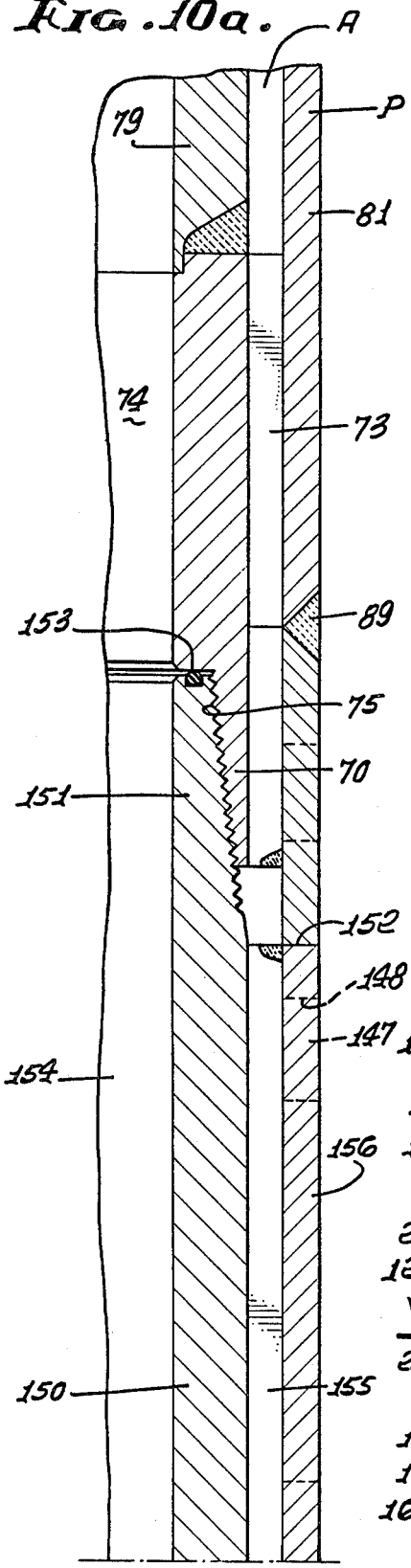
Figure 10B:
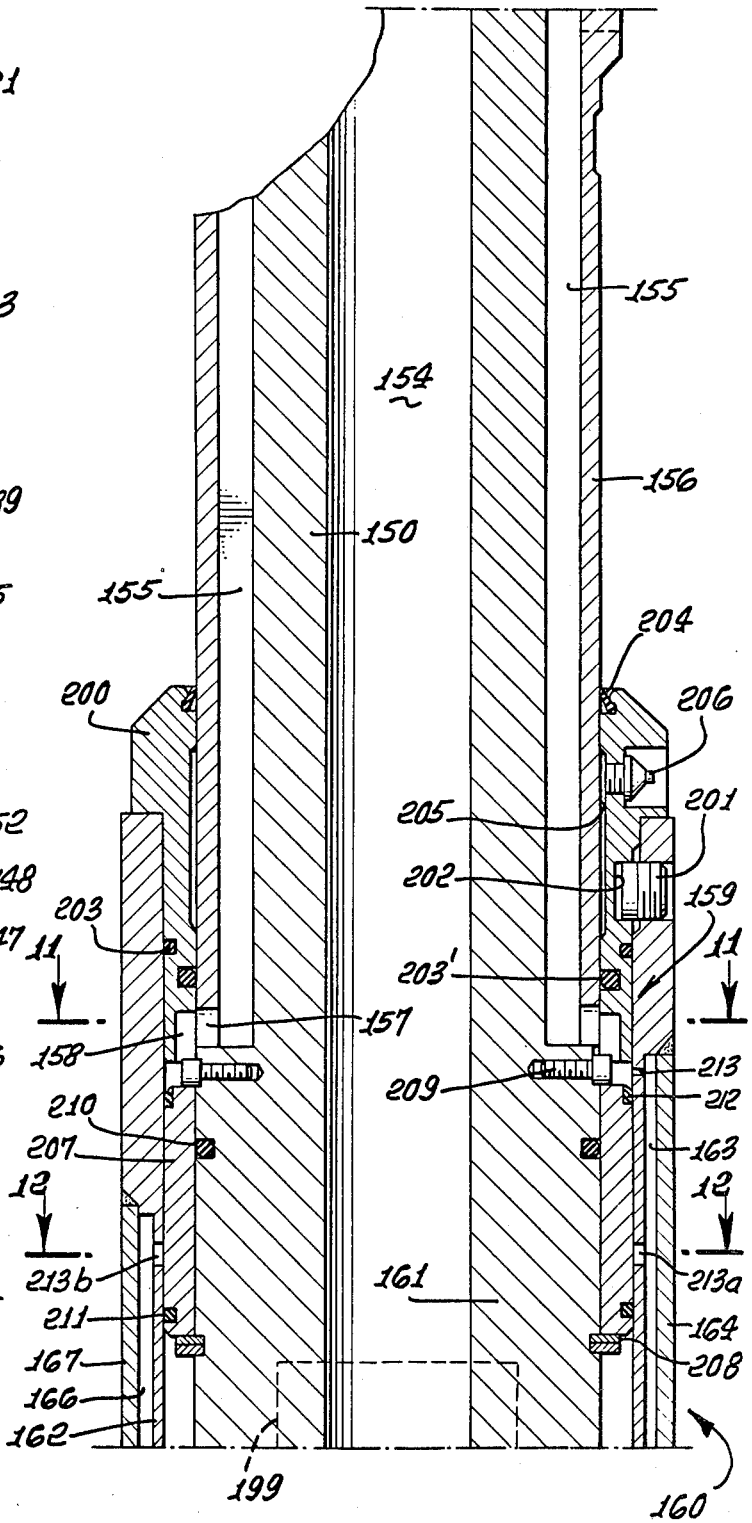
Figure 10C:
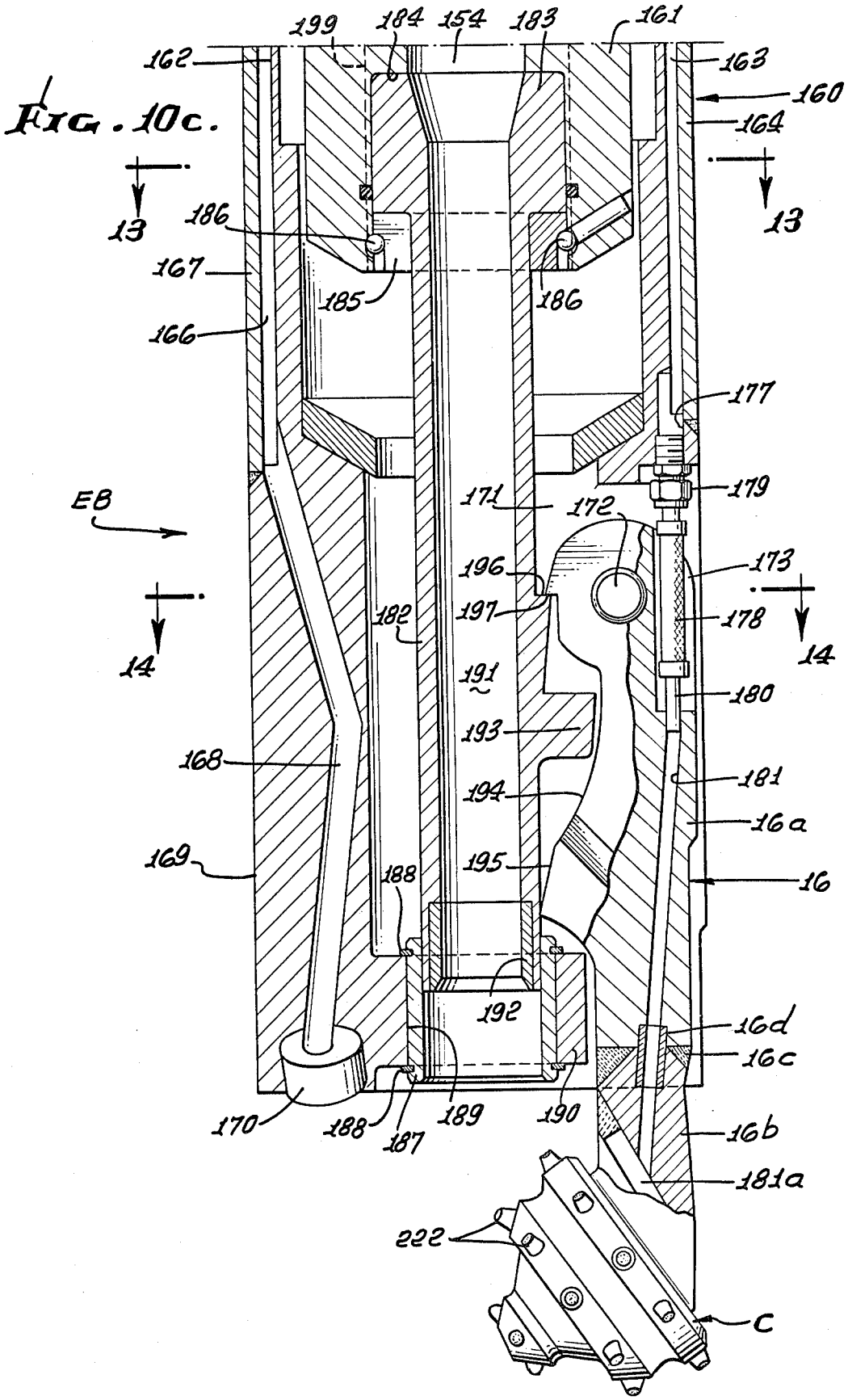

FIGS. 10*a,* 10*b* and 10*c,* together, constitute a vertical section, as taken on the line 10—10 of FIG. 2, showing the expansible bit used to enlarge the bore hole with the cutters in retracted condition, FIGS. 10*b* and 10*c* being successive downward continuations of FIG. 10*a;*

Figure 11:
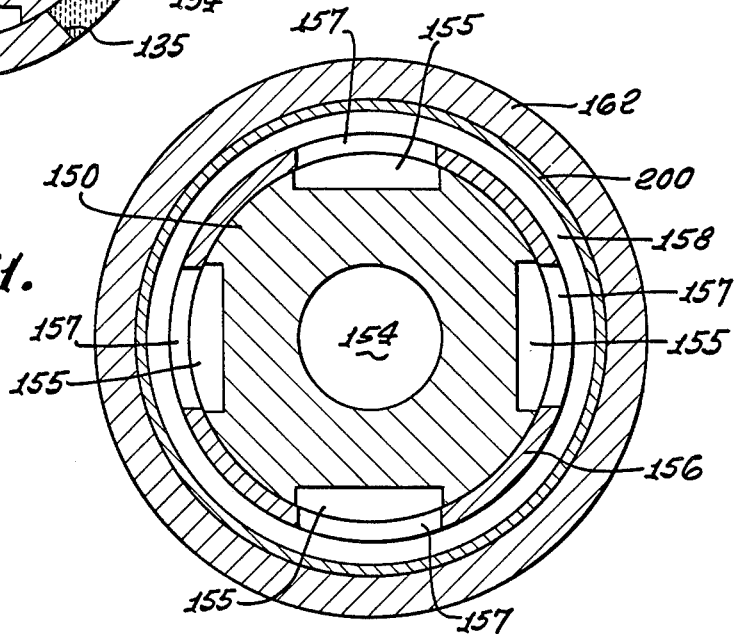

FIG. 11 is a transverse section as taken on the line 11—11 of FIG. 10*b;*

FIG. 12 is a transverse section as taken on the line 12—12 of FIG. 10*b;*

FIG. 13 is a transverse section as taken on the line 13—13 of FIG. 10*c;*

FIG. 14 is a transverse section as taken on the line 14—14 of FIG. 10*c;*

Figure 15A:
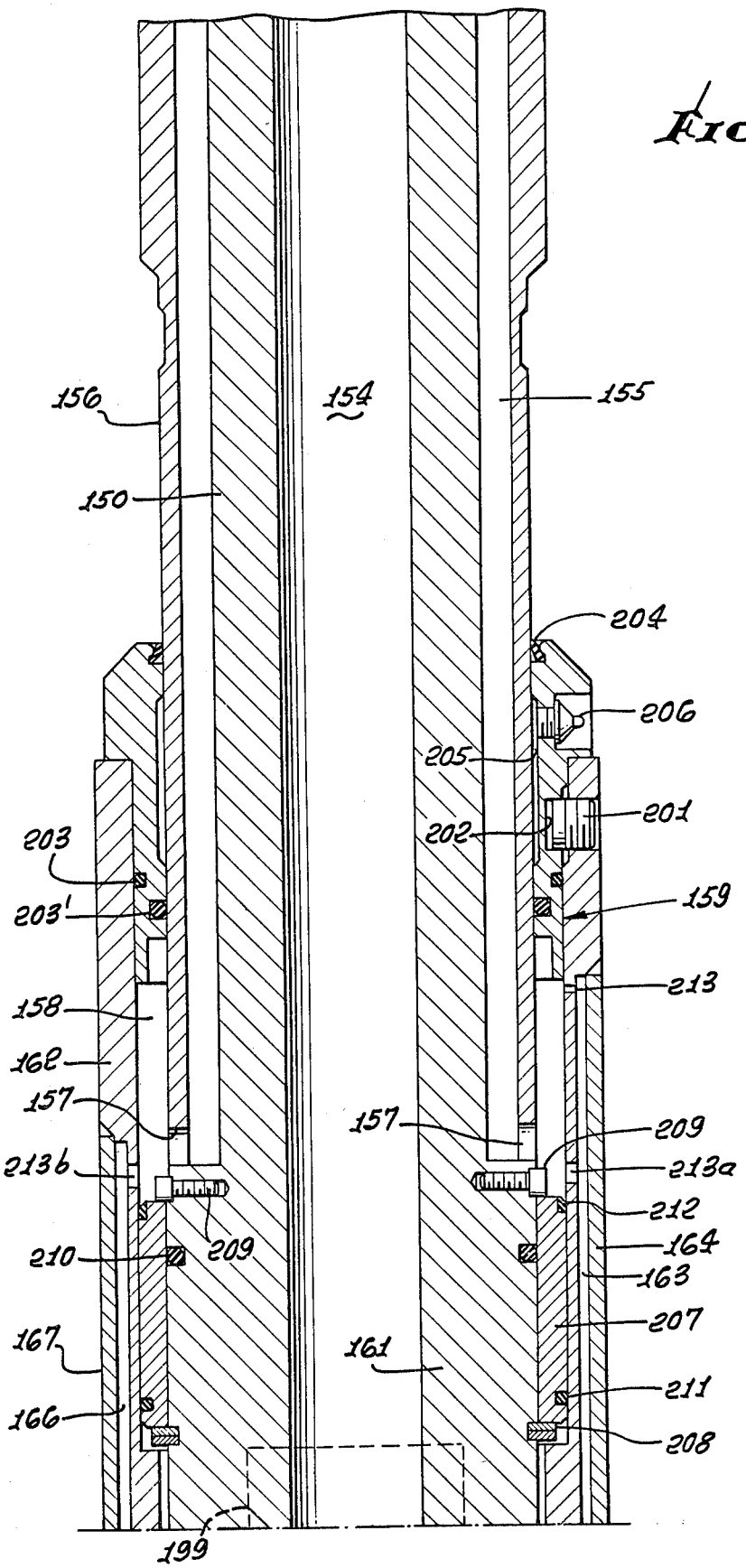
Figure 15B:
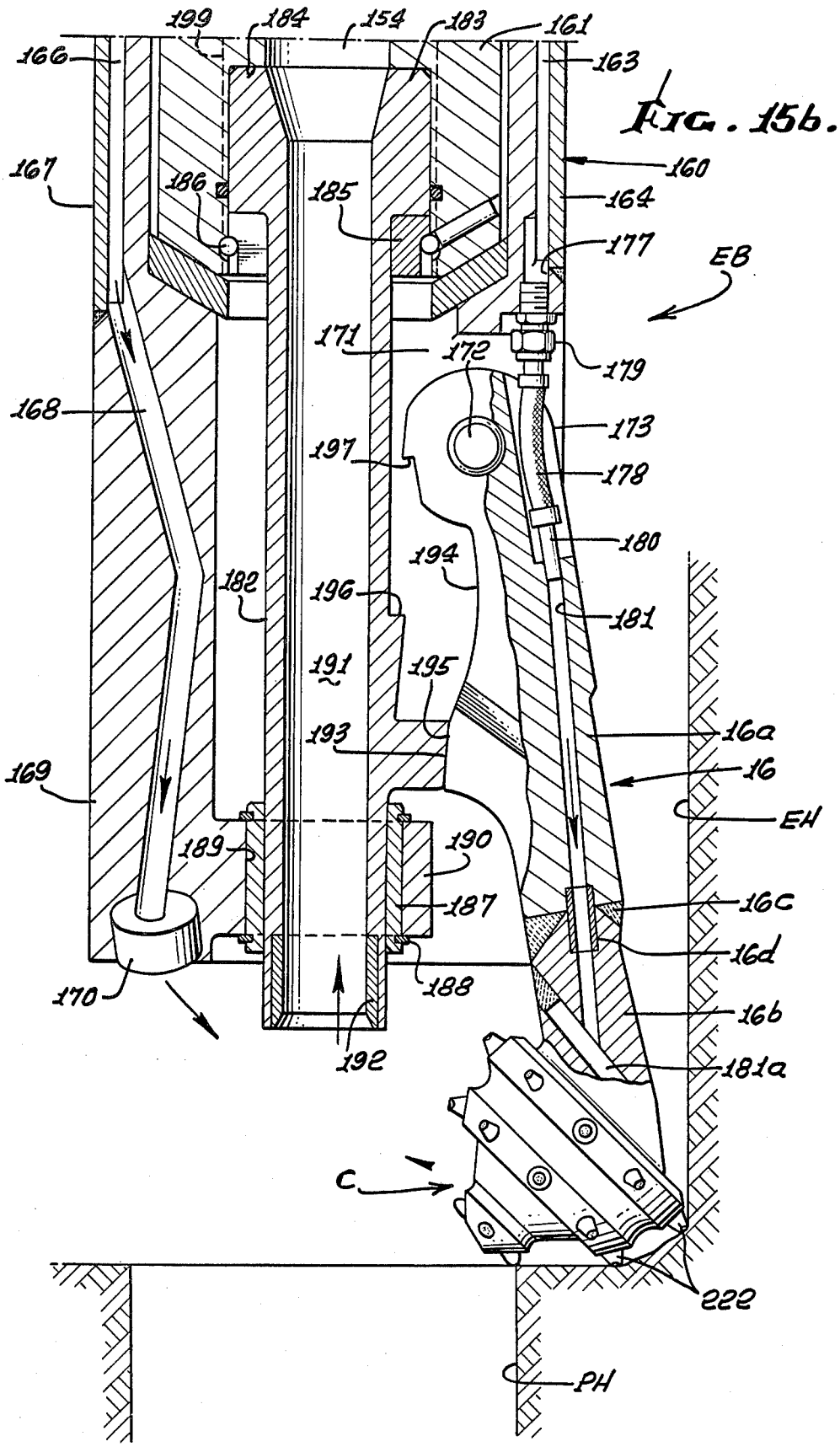
Figure 16:
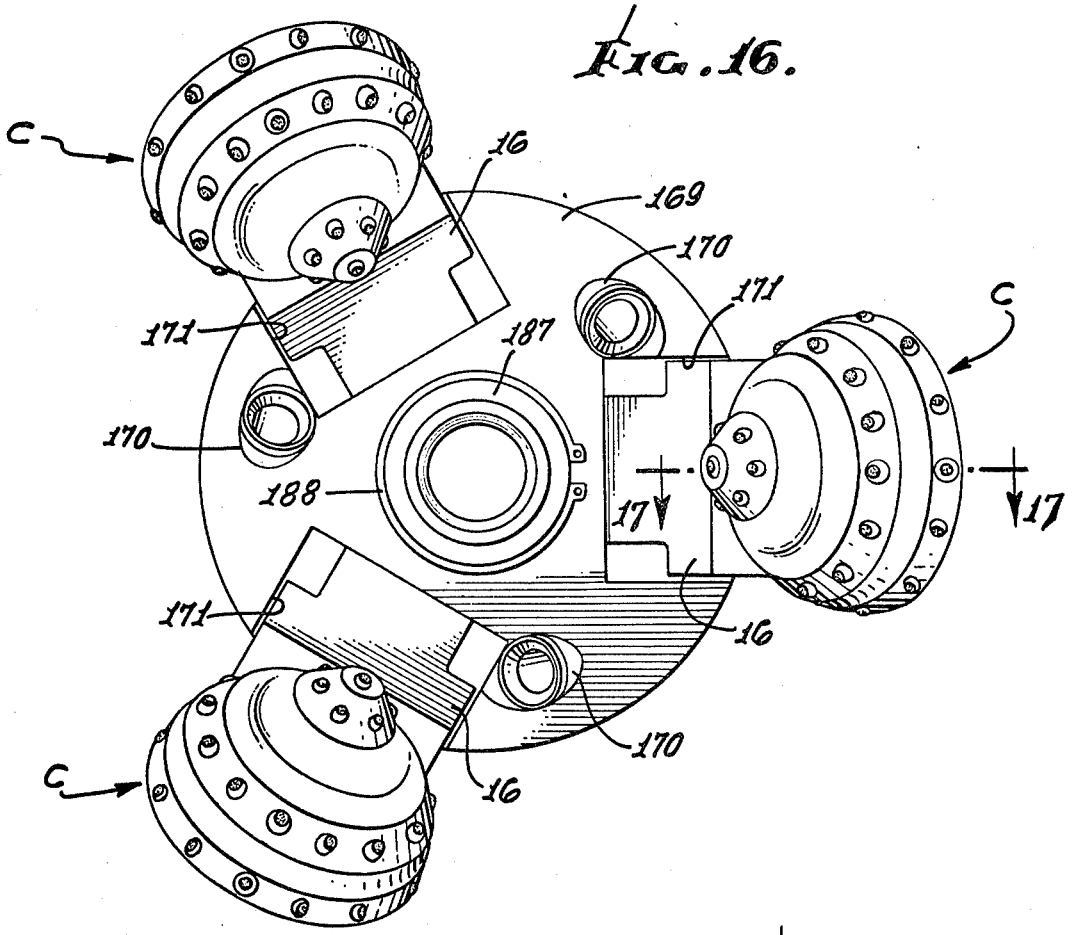
Figure 17:
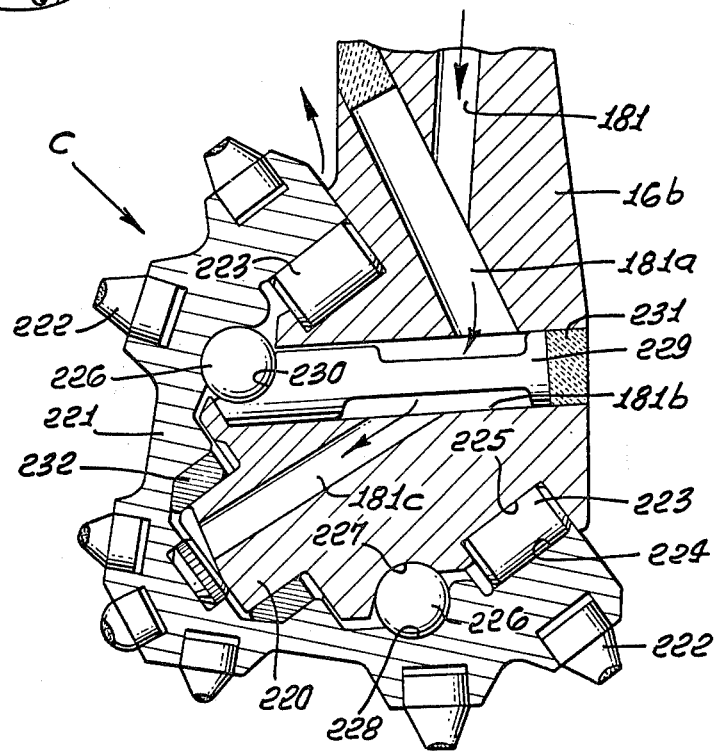

FIG. 15*a* and 15*b,* together, constitute a vertical section corresponding to FIGS. 10*b* and 10*c,* but showing the cutters expanded as in FIG. 2;

FIG. 16 is a bottom plan of the expansible bit, with the cutters expanded as in FIG. 15*b;* and FIG. 17 is an enlarged section, as taken on the line 17—17 of FIG. 16, showing the details of one of the air cooled cutters.

Figure 1A:
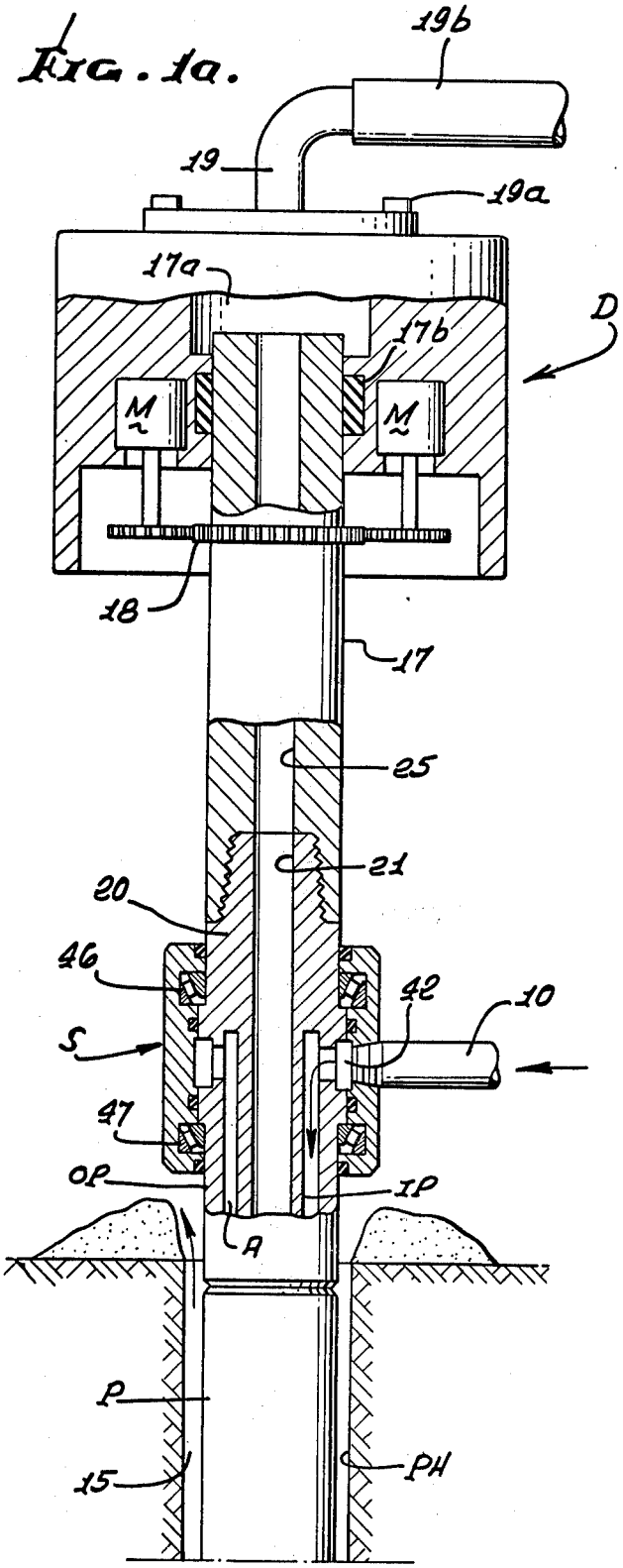
Figure 1B:
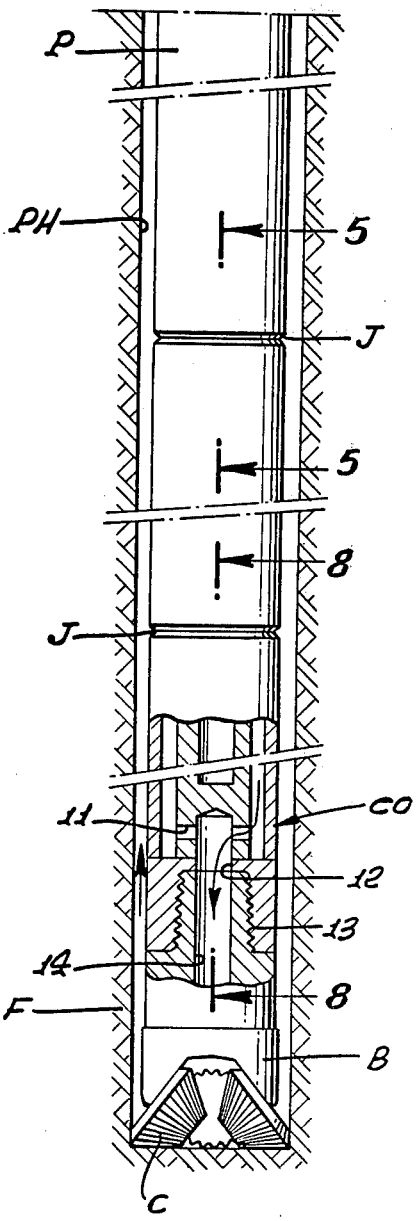
Figure 2A:
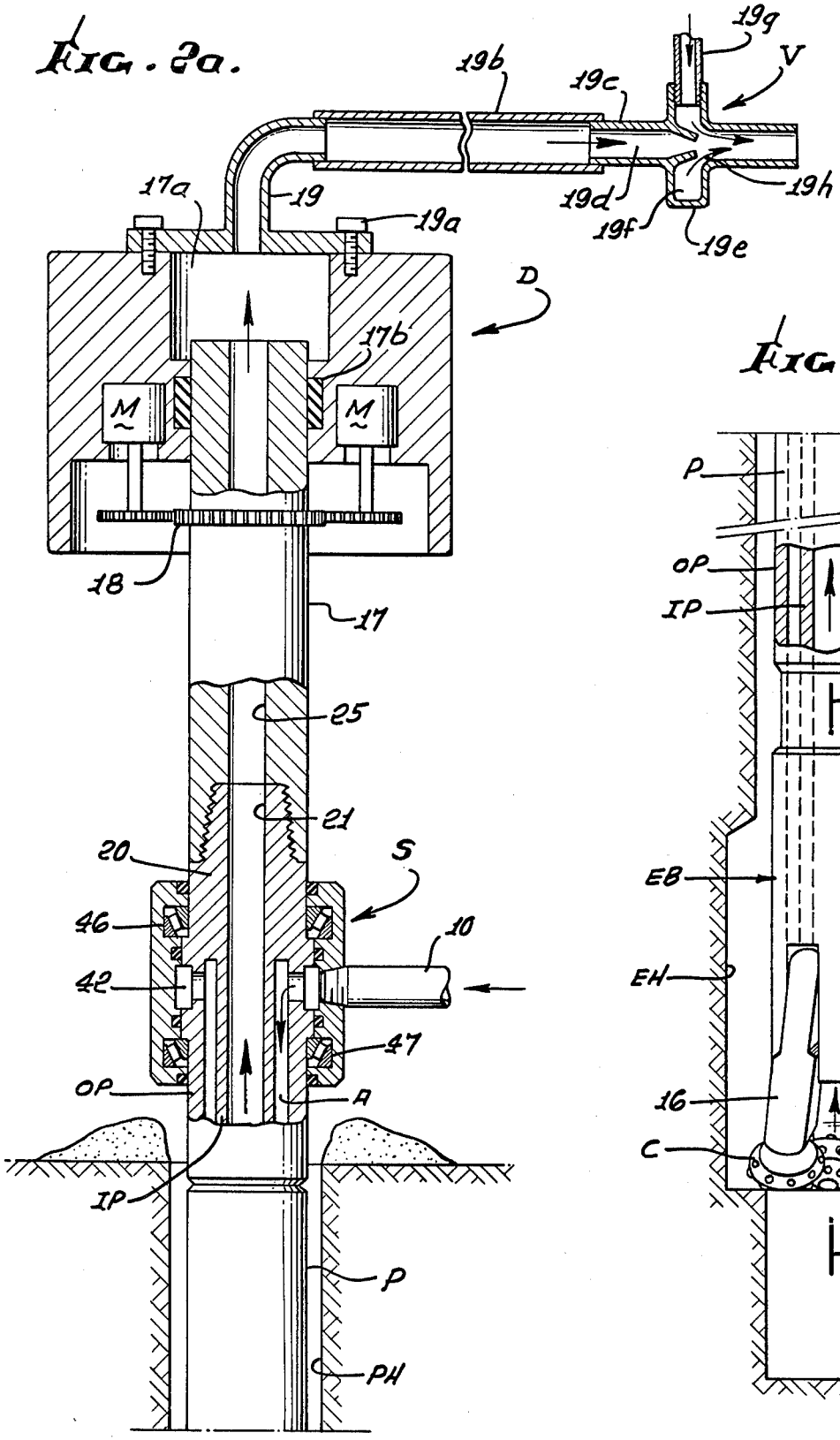
Figure 2B:
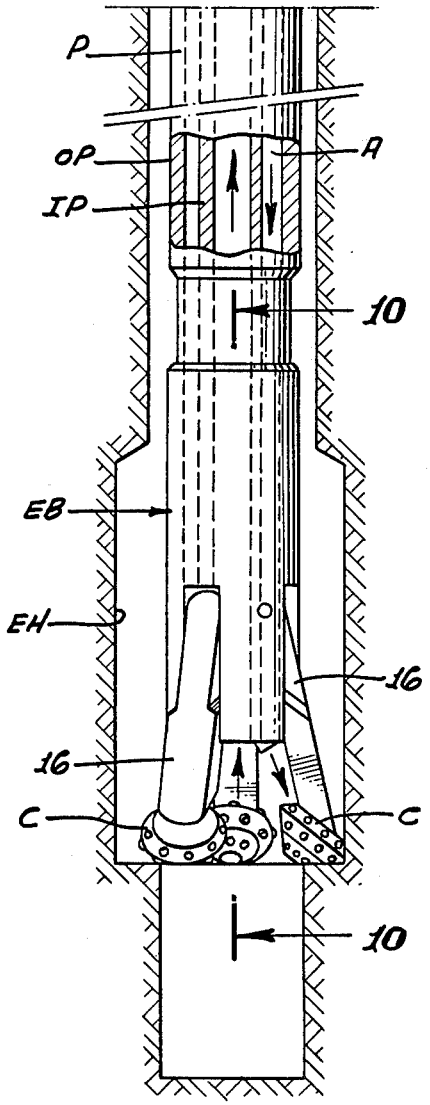
Figure 3A:
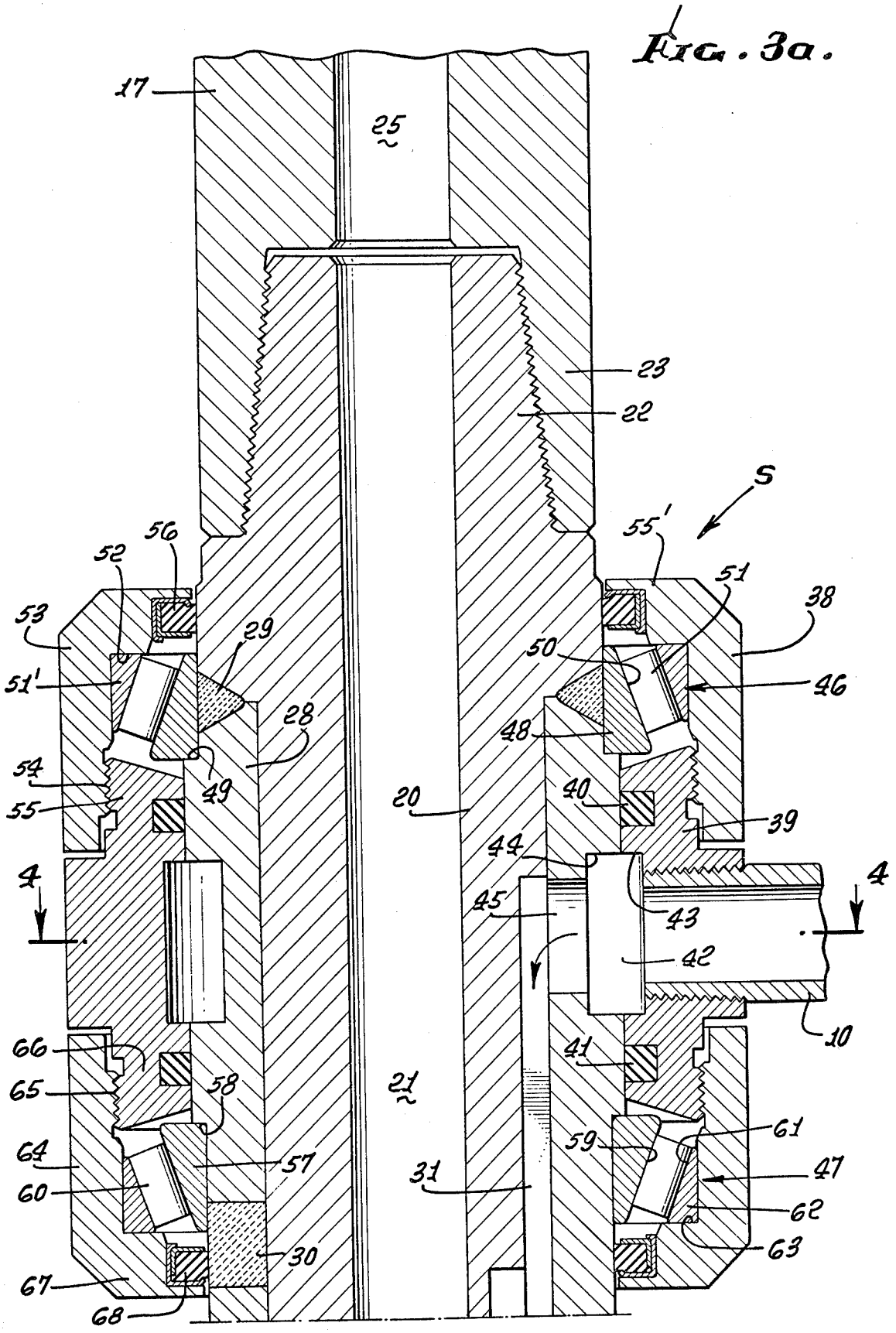
Figure 3B:
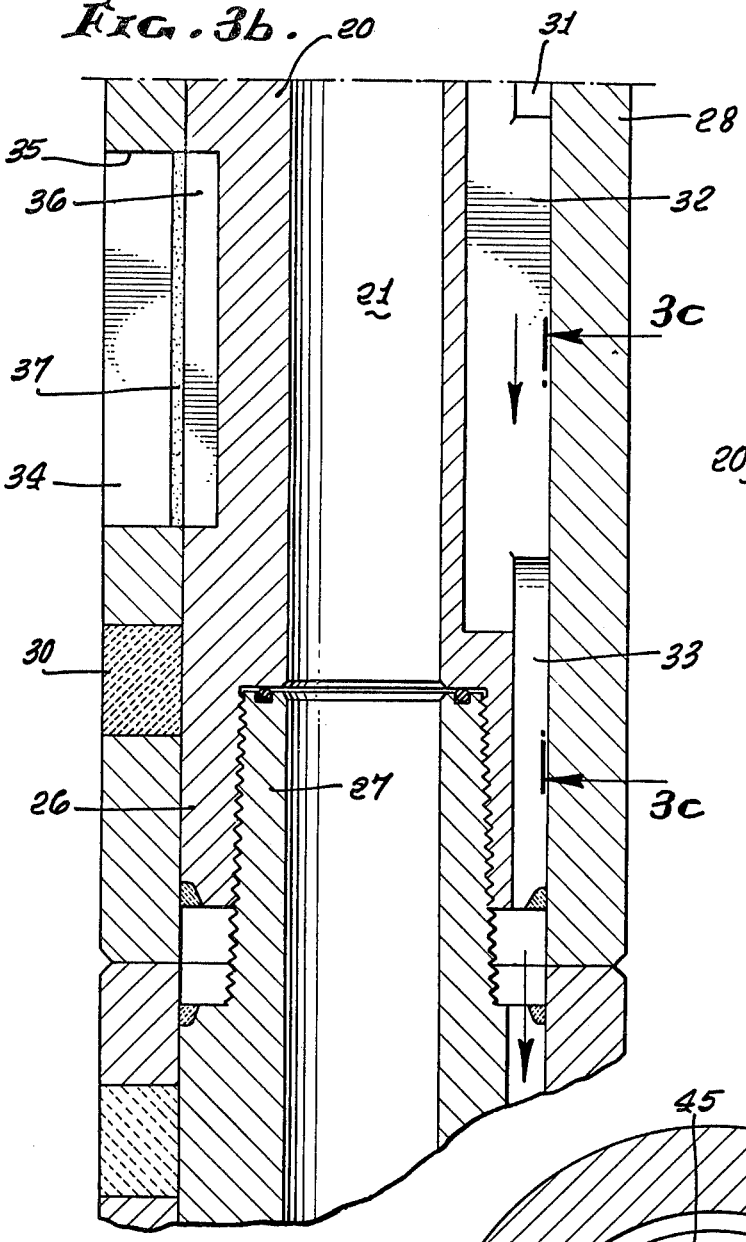
Figure 3C:
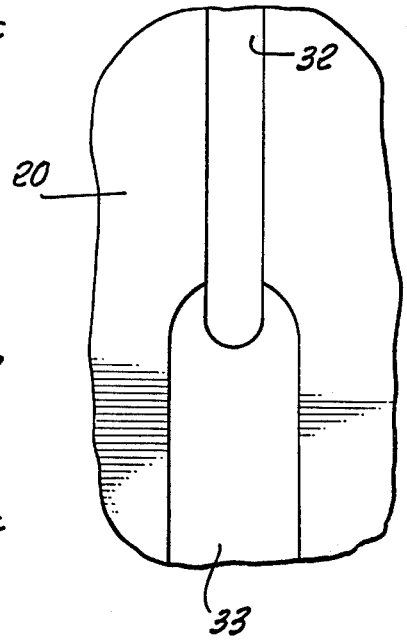
Figure 4:
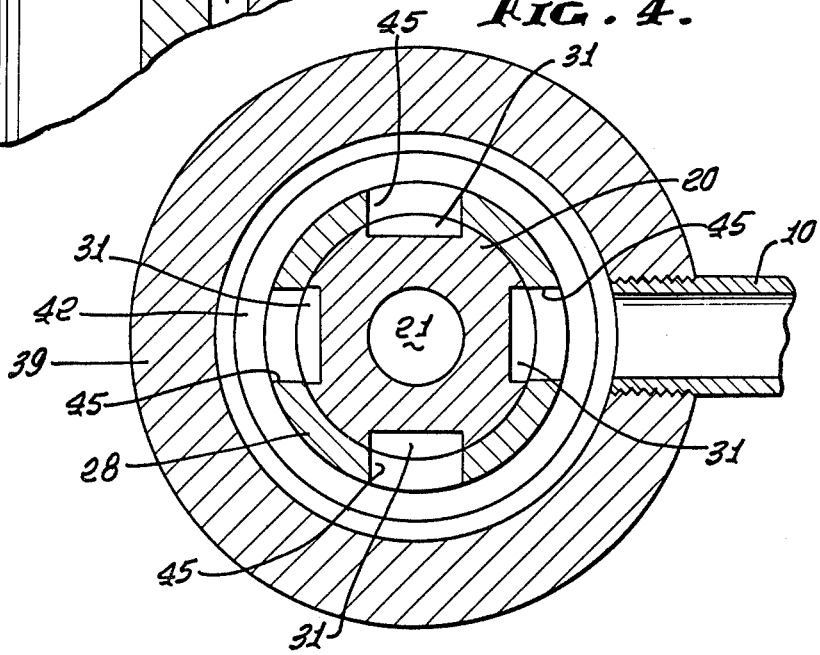

As seen in the drawings, referring first to FIGS. 1*a* and 1*b,* and FIGS. 2*a* and 2*b,* apparatus is diagrammatically illustrated for first drilling a pilot bore hole PH (FIGS. 1*a* and 1*b* by drilling through the earth formation F with the usual drilling bit B, secured to the lower end of a string of rotatable drill pipe P, adapted to be rotated by a suitable rotary drive unit D, whereby the cutters C on the bit B progressively drill the bore or pilot hole PH as the drill pipe P is rotated, and drilling fluid is supplied through a swivel S from a suitable source of drilling fluid, such as a compressor for air in the case of drilling with air, via a supply conduit 10. As illustrated, the drill pipe string P is a dual concentric drill pipe having an inner pipe IP and an outer pipe OP made up in appropriate lengths or sections secured together at joints J and defining an annular space A therebetween communicating through the respective joints, whereby drilling fluid or air supplied through the swivel S, from the pipe 10 through the annular space A to a crossover unit CO in which the annular space A communicates through lateral passages 11 with a central bore 12 at the lower end of the crossover unit. The bit B is connected to the lower end of the crossover unit by the usual threaded connection 13 and has a central passage 14 therethrough, through which the drilling fluid or air passes from the crossover passage 12, exiting into the bore hole PH through the bit B and returning to the surface of the earth or to the starting end of the bore hole through the annular space 15 defined between the bore hole wall and the drill pipe string P. The flow of the drilling fluid or air is operative to cool the cutters C of the bit B and to flush or bail cuttings from the bore hole as the drilling progresses.

It is generally known that the velocity of air upwardly through the annular space 15 between the drill pipe and the bore hole wall must be on the order of 5000 feet per minute in order to bail the cuttings from the bore hole. When, as shown in FIG. 1*b,* the gauge of the bit B is only slightly larger than the diameter of the drill pipe string P, the annular cross-sectional area of the annulus 15 can enable the air to flow with sufficient velocity; for example, if air is supplied from a compressor through the annulus A of the drill pipe string at 1300 SCFM, the diameter of the drill pipe is $5\frac{3}{4}''$ and the gauge of the bit is $7\frac{7}{8}''$, and the bore hole is fairly regular, having no large cavities or enlargements therein, the bailing velocity of the air returning through the annulus 15 will be on the order of in excess of 8000′ per minute, or well in excess of the minimum velocity required for removing the cuttings. With this in mind, the drilling of bore holes using air, generically including other gas, as the drilling fluid supplied through the drill pipe string, either of the ordinary type or of the dual concentric type, has been widely used as a drilling fluid in drilling bore holes into various earth formations, including bore holes for blasting or other mining operations, as well as in the drilling of well bores.

As seen in FIGS. 2*a* and 2*b,* the same drill pipe string P, but without the crossover structure CO, has been connected to a hole opener or bore hole enlarging bit EB of the expansible cutter type, having pivoted cutter supporting arms 16 provided with the cutters C at the lower free ends thereof, adapted to form the enlarged bore hole or chamber EH, as the expansible cutters are swung outwardly and the drilling progresses. If air were to be supplied through the swivel S to the drill pipe string P in the same manner as described with respect to FIGS. 1*a* and 1*b* in and effort to flush or bail the cuttings from the enlarged bore hole or chamber EH, the bailing velocity would be below the minimum value required. For example, if the enlarged bore hole EH is 13″ in diameter, and drilling air is supplied at 1300 SCFM, the air velocity within the enlarged bore hole would only be slightly more than 1700′ per minute. In accordance with the present invention however, the air is supplied through the swivel S to the annulus A between the inner and outer pipes IP and OP, as shown by the arrows, flowing downwardly into the bore hole, and then entering the center pipe IP and flowing upwardly therethrough, exiting from the top thereof. If it is assumed that the bore of the inside pipe is 2″ in diameter, and all of the air returned to the surface through the 2″ bore, supplied through the annulus A at 1300 SCFM, then the bailing velocity would be on the order of 60,000′ per minute. Thus, if merely 10% of the air entering the bore hole returns through the inner pipe, the bailing velocity would still be on the order of 6000′ per minute, which is in excess of the minimum velocity required to bail the cuttings.

As is known, baffles between the pipe string P and the wall of the bore hole PH may be employed to assure adequate flow of air up the center of the drill pipe string. However, in accordance with the present invention, as seen in FIG. 2*a,* the flow of air up through the center pipe is enhanced by the provision of means V for drawing air through the inner pipe IP. The drive unit D is shown diagrammatically as having an inner drive pipe 17 driven by gearing 18 which is powered by suitable motors, such as hydraulic motors M. Fluid and cuttings flow upwardly through the drive pipe 17 into a discharge chamber 17*a* in the drive unit housing, the pipe 17 having a packing 17*b* engaged therewith to prevent entry of dust into the drive unit housing. An outlet connection 19 is connected to the housing by fasteners 19*a* and establishes a flow path from the housing chamber 17*a* to a discharge hose 19*b.*

The venturi means V is associated with the discharge hose 19*b* so as to induce flow through the hose and thus induce flow upwardly through the center of the drill string. The venturi includes a housing 19*c* installed in the discharge hose 19*b* and having a flow passage 19*d* therethrough. A flange 19*e* on the housing 19*c* has an annular space or passage 19*f* to which air is supplied by an inlet conduit 19g. An annular gap 19h opens from the annular passage 19f into the flow passage 19d in a downstream direction to reduce pressure in passage 19d upstream of the gap thereby inducing fluid flow from the borehole upwardly through the inner drill pipe and through the discharge hose, as air is supplied through the swivel S and flows down the annulus A between the inner and outer pipes and enters the bore hole through the bit.

The venturi or vacuum producing means V provides a further advantage after the completion of the enlargement of the bore hole, when the supply of drilling air is discontinued. When the drilling operation is concluded, the bore hole will contain a quantity of cuttings and dust which have been lifted within the annular space within the bore hole outside of the drill pipe and which will settle to the bottom of the hole. The continued application of air to the venturi will induce flow through the discharge conduit which continues to draw air up the center pipe and will continue to lift the cuttings from the bottom of the bore hole in a vacuuming operation. During the vacuuming operation, the drill pipe P can be rotated to cause the cutters on the bit to agitate the cuttings at the bottom of the hole.

Referring to FIGS. *3a, 3b, 3c* and 4, the swivel structure S is shown in greater detail. Internally, the swivel structure includes an elongated body or mandrel 20 having a central flow passage 21 therethrough. At its upper end the body 20 has an externally threaded pin 22 threaded into an internally threaded box 23 of the rotary drive member 17, which is adapted, as described above, to be rotated by drive unit D. The rotary drive member 17 has a central passage 25 therethrough which communicates with the swivel passage 21 and with the discharge conduit and venturi means V. At its lower end, the swivel body or mandrel 20 has an internally threaded box section 26 connected to an externally threaded pin 27 forming a joint J therewith.

A tubular outer body section 28 is disposed about the body of mandrel 20 and welded thereto at appropriate locations to rigidly unite the inner and outer body sections together. As shown, the outer body 28 has an upper weld 29 securing it to the upper portion of the inner body section, and a suitable number of longitudinally and circumferentially spaced welds 30 formed in drilled holes in the outer body section are also provided to secure the body sections together. Prior to assembly of the outer body section 28 on the inner body, the inner body is provided with a number of circumferentially spaced longitudinally extended milled slots 31 which communicate with further downwardly extending and circumferentially spaced slots 32 (FIG. *3c*), through which slots air is adapted to flow downwardly between the mandrel body sections. The slots 32, as seen in FIG. *3c*, are narrower than the slots 31 and 33, but of greater depth so as to have approximately the same effective air flow areas. Reduction in the width of the slots 32 enables the formation in the swivel body at a number of circumferentially spaced locations, of outwardly opening wrench slots 34 which extend longitudinally of the body and provide a downwardly facing shoulder 35, whereby a vertical supporting tool and holding tool can be applied to the body by the drilling rig, as is also well known. The wrench slots 34 are partially formed by external slots 36 formed in the exterior of the inner body section 20, and preferably a bead of weld 37 is formed about the interface of the body parts within the wrench slot 34. Disposed about the rotatable swivel body structure is an outer swivel housing structure 38, adapted to be held stationary in an appropriate supporting arrangement which allows downward movement of the swivel assembly during the drilling operation. The supporting arrangement is not illustrated herein since it is not germane to the present invention and various supporting arrangements can be utilized, as well known in the use of apparatus of the type here involved.

More particularly, the outer stationary swivel structure 38 comprises a central annular section 39 disposed about the rotatable internal body structure and carrying suitable internal side ring seals 40 and 41 in axially spaced relation. The seals 40 and 41 are preferably elastomer seals and are adapted to confine the air from the air inlet conduit 10 against leakage from the swivel assembly. As seen in FIG. *3a*, the conduit 10 opens into an annular space 42 defined by companion annular grooves 43 and 44 in oposed relation in the cylindrical walls of the swivel member 39 and outer body section 28 of the swivel mandrel. Leading between the annulus 42 and the respective longitudinally extended flow passages or slots 31 in the mandrel is a number of circumferentially spaced radial ports 45. Upper bearing means 46 and lower bearing means 47 rotatably support the inner mandrel structure within the outer swivel structure. The upper bearing means 46 includes an inner bearing race 48 seating on a shoulder 49 provided on the outer mandrel body section 28 and having an inwardly and upwardly inclined race or surface 50 engaged by bearing elements or rollers 51. An outer race member 51' is engaged by the bearing rollers 51 and engages in a seat 52 provided within a bearing retainer and sealing sleeve 53. This sleeve 53 is threaded at 54 onto an upwardly extended annular flange 55 provided on the central swivel housing member 39 and has an upper circumferentially extended and inwardly projecting flange 55' which carries an internal sealing ring structure 56 slideably and sealingly engaging with the outer cylindrical surface of the mandrel body section 20, so as to protect the bearing means 46 from erosive dust and dirt. Correspondingly, the lower bearing means 47 has an inner race 57 seating in a seat 58 provided on the mandrel body structure and having a downwardly and inwardly inclined surface or raceway 59 engaged by bearing elements or rollers 60 which also engage the opposing upwardly and outwardly inclined raceway 61 of an outer bearing race 62 disposed in a seat 63, which is provided by a lower bearing retainer sleeve 64. This sleeve 64 is threadedly connected at 65 to a downwardly extended annular flange 66 provided on the mandrel housing central member 39 and has a circumferentially extended and inwardly projecting lower flange 67, which carries an internal seal assembly 68 slideably and sealingly engaging with the outer cylindrical surface of the mandrel structure to prevent the entrance of foreign matter into the lower bearing assembly 47. It will be seen that the outer swivel housing structure 38 can be easily assembled about the swivel mandrel structure and disassembled for service or repair by threadedly disconnecting the respective bearing retainer sleeves 53 and 64 from the central housing member 39. In addition, when the bearing retainers 53 and 64 are removed, the central housing member 39 can be moved axially upwardly from the end of the swivel mandrel to allow service and replacement of the seal rings 40 and 41.

Referring to FIGS. *5a* and *5b*, as well as to the sectional views 6 and 7, a typical joint J is illustrated. Each joint J includes a box end 70 and a pin end 71. The box end 70 comprises an inner tubular member 72 having a suitable number of circumferentially spaced and longitudinally extended flow passages 73 milled therein and having a central flow passage 74 therethrough. At its lower end, the member 72 has a downwardly and outwardly tapered internal thread 75 adapted to receive the complimental external thread 76 on the pin section. At its upper end, the box member 72 has an annular seat 77 circumscribing the flow passage 74 and receiving a downwardly extended cylindrical end portion 78 of an elongated pipe section 79, which is welded to the box member 72 as by a circumferentially continuous weld 80. Disposed about the pipe 79 and defining therewith the annular space A is an outer elongated pipe 81 which is welded by a suitable number of circumferentially spaced welds 82 in radial openings 83 to the upper end of the box body member 72. Also, welded to the box body member 72 is a downwardly extended connector sleeve 84 which extends downwardly about the box body 72 and provides a downwardly facing end or shoulder 85 projecting downwardly below the lower end 86 of the threaded box section. The sleeve 84 is welded to the box body section 72 by means of a suitable number of circumferentially spaced welds 87 provided in radial openings 88 in the sleeve 84. In addition, a circumferentially continuous weld 89 is provided between the opposing ends of the upper pipe section 81 and the downwardly extended sleeve 84. The outer connector sleeve 84 and the inner box member 72 are also united adjacent their lower ends by a weld 90 which extends circumferentially at the juncture of the lower end of the inner body 72 with the internal periphery of the connector sleeve 84 above the lower end shoulder 85. As seen in FIG. 5*b*, the upper end of each length of pipe having the pin end 71 of the respective joints J, has the external thread 76 on the upwardly and inwardly tapered pin section 91 which is provided on a pin body section 92 having a longitudinally extended bore or fluid passage 93 therethrough adapted to be aligned with the passage 74 through the box end 70 of the coupling. At its lower end, the pin body section 92 has an internal annular seat 94 receiving an upwardly extended cylindrical end section 95 of the center pipe 79 which is welded to the body section 92 by a circumferentially continuous weld 96. Formed in the outer periphery of the pin body section 92, adjacent the upper end thereof, is a number of circumferentially spaced longitudinally extended slots 97 which communicate with relatively narrower but deeper longitudinally extended slots 98, which at their lower ends communicate with further longitudinally extended slots 99. The slots 97 communicate with an annular space 100 between the lower extremity of the box end 86 and an upwardly facing surface or shoulder 101 at the upper end of an outer pin connector sleeve 102. The lower slots 99 communicate with the annular space A between the lower pipe 81 and the inner pipe 79 of the subjacent unit. As in the case of the slots 32 and 33 described above, the cross-sectional area of the slots 97 and 99, by reason of their relatively greater circumferential extent than the narrower slots 98, have substantially the same cross-sectional air flow area as the slots 98. The outer pin sleeve 102 is welded to the inner pin body section 92 by a suitable number of circumferentially spaced welds 103 formed in radial openings 104 in the sleeve 102, as well as by a weld 105 formed at the upper end of the sleeve 102 and the upper outer edge of the pin body 92.

Figure 7:
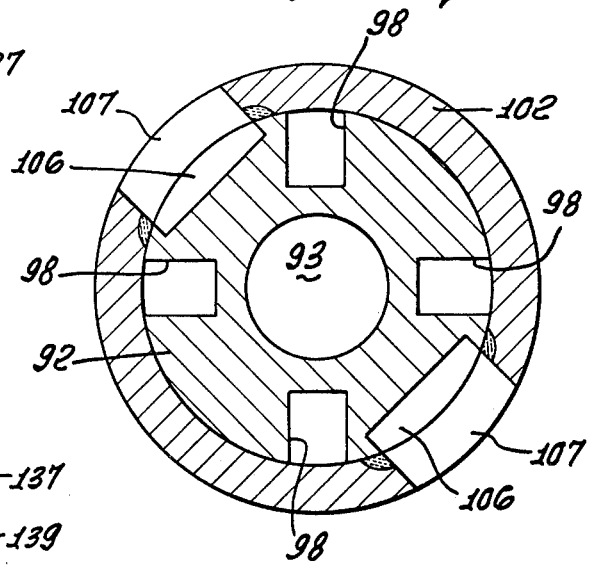
FIG. 7 is a transverse section as taken on the line 7—7 of FIG. 5*b;*

As seen in FIG. 7, the relatively narrow circumferentially spaced slots 98 provide a substantial segment of the body 92 wherein the circumferentially spaced or diametrically opposed wrench slots 106 can be formed, these slots 106 extending longitudinally and circumferentially to provide opposed longitudinally extended shoulders 107 and a downwardly facing horizontal face 108 engageable with the usual holding and supporting members of the drilling rig. With the pin end held by the projections provided on the rig and engaged in the wrench slots, the superjacent pipe length can be rotated by the rig to make up the threaded connection between the pin and the box.

Figure 5A:
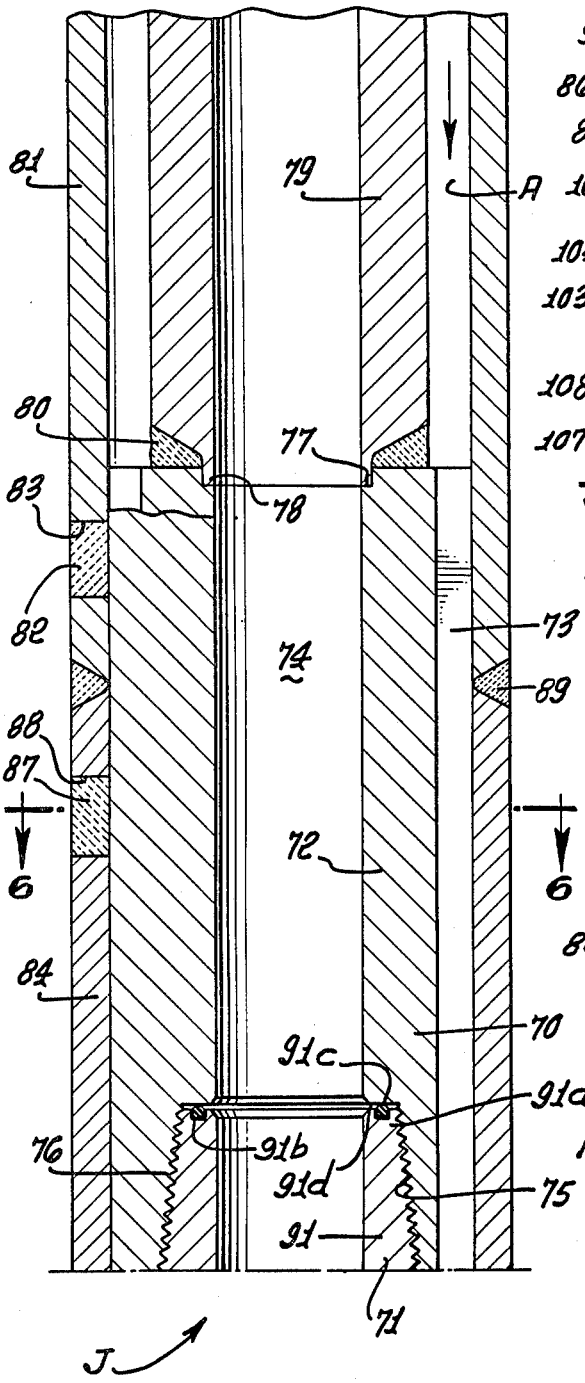
Figure 5B:
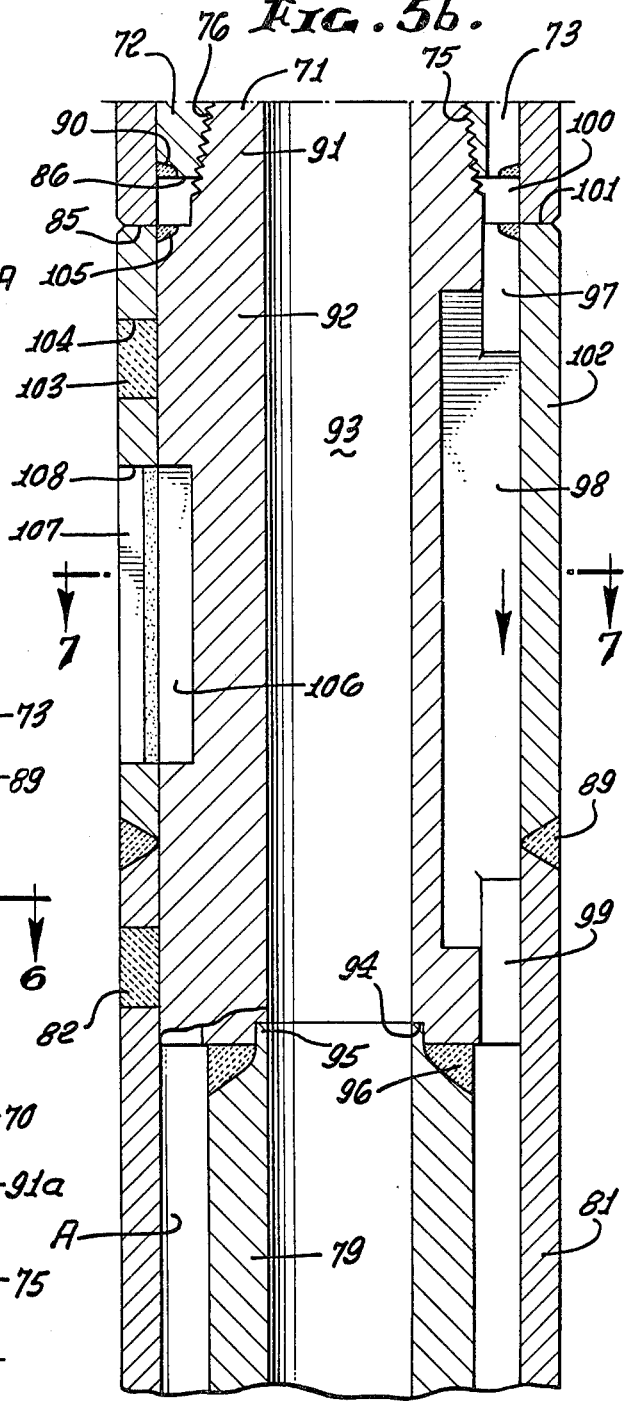
Figure 6:
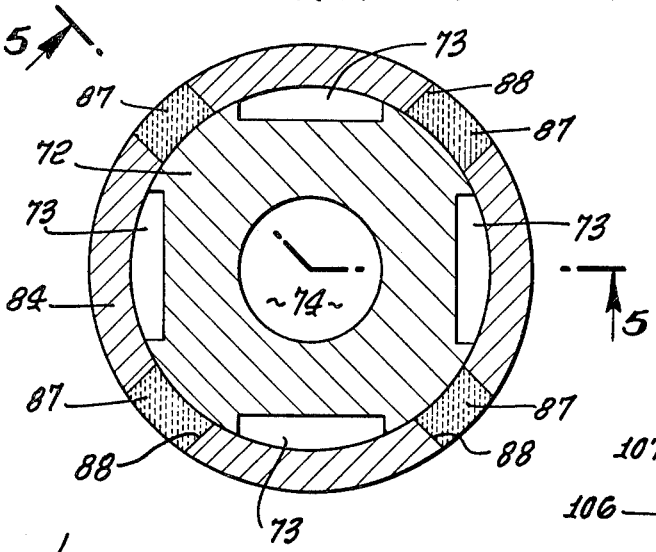
FIG. 6 is a transverse section as taken on the line 6—6 of FIG. 5*a;*

Referring to FIG. 5*a*, it will be noted that in the upper end 91*a* of the pin 91, a resilient sealing means is provided for engagement with the box body section 72. More particularly, the end 91*a* of the pin section 91 has a circumferentially extended annular groove 91*b* therein, in which is disposed an annular elastomeric or other resilient sealing ring 91*c*, which normally projects outwardly or above the surface 91*a*. The seal ring 91*c*, upon making up of the joint, it adapted to resiliently and sealingly engage against a downwardly facing shoulder 91*d* provided within the box body section 72. This sealing arrangement allows the pin and box sections to shoulder at the shoulders 101 and 85, forming a fluid tight seal between the inner and outer pipes, while the resilient seal ring 91*c* prevents air flow from the annulus A into the central passage through the inner pipe.

Referring to FIGS. 8*a* and 8*b*, the crossover sub or assembly CO is illustrated in detail. The assembly comprises an elongated center section having a flow passage 110 extending therethrough and including an upper inner body section 111 having a threaded pin end 112 engaged in the box thread 75 at the lower end of the pipe section thereabove. At its lower end, the inner body member 111 has an annular seat 113 receiving the end projection 114 of a lower, elongated crossover body section 115, welded to the body section 111 by a circumferentially continuous weld 116. The upper body section 111 has elongated slots 117 milled therein, opening at their lower ends into the annular space A between the inner body section 115 and the outer tubular body 118, which is welded at 119 to the upper, outer body section 120 which provides the upwardly facing shoulder 121 engageable with the downwardly facing shoulder 85 of the upper pipe section, when the connection is threaded together. Also, as previously described, the pin 112 carries in its upper end surface an annular resiliently deformable or elastomeric seal ring 122 which prevents air flow from the annulus A into the central passage through the assembly. The upper, outer body section 120 is welded to the inner body section 111 by a suitable number of welds 123 formed in holes 124 in the outer body section, and the lower outer body section 118 is also welded to the inner upper body section 111 by a suitable number of welds 125 formed in holes 126 in the body section 118 below the weld 119.

At the lower end of the crossover assembly CO, the inner tubular body member 115 and the outer tubular body member 118 are joined to a crossover and connector member 127 which has an internally threaded box 128 connected to the externally threaded pin 129 of the bit B. The crossover and connector member 127 has a cylindrical body 130 providing an annular seal 131 which receives a downwardly extended cylindrical end portion 132 of the inner body section 115, the two parts being welded together by circumferentially continuous weld 133. It will be seen that the connector body 130 blanks off the lower end of the fluid passage 110 in the center of the upper body section. The outer tubular body 118 is rigidly connected to the crossover and connector body 127 by a number of circumferentially spaced welds 134 formed in holes 135 in the portion of the body 118 which surrounds the cylindrical crossover body 130. Another circumferentially continuous weld 136 is provided between the lower end of the body section 118 and the crossover connector 127.

A number of circumferentially spaced elongated milled slots 137 in the side of the crossover body 130 communicate with the annular space A and with a number of radial ports 139 formed in the crossover body 130 and extending between the slots 137 and a central bore 140 in the connector body 130. The bore 140 opens downwardly into the central flow passage 141 through the bit B, whereby air flowing downwardly through the annular space A finds access to the bit B and discharges into the bore hole, as previously described with respect to FIG. 1*a*.

Referring to FIGS. 10*a* through 10*c*, the expansible cutter hole opener or hole enlarging bit of the invention is shown in detail. The bit EB includes an elongated tubular body 150 having an upper pin end 151 threadedly engaged in the thread 75 at the lower end of a length of the drill pipe P and shouldering at 152 with the lower end of the drill pipe section, the pin 151 carrying at its upper end an elastomeric or resilient seal ring 153 engagable within the box 70 to provide a seal between the outer flow path and the inner flow passage 154 which extends through the body of the hole opening bit.

Extending along the bit body 150 in circumferentially spaced locations is a number of elongated milled slots 155 which communicate through the connection at the upper end of the body with the annulus of the drill pipe string, the outer body sleeve or member 156 of the bit body being welded at a number of circumferentially spaced locations by welds 147 formed in holes 148 in the body member 156 in angularly spaced relation to the slots 155.

At the lower end, the fluid passages 155 communicate through lateral openings 157 (FIG. 11) in the outer body member 156 with an annular piston chamber 158 provided by piston and cylinder means 159. This piston and cylinder means 159 is adapted to longitudinally shift an outer cutter carrying support section 160 of the bit upwardly with respect to an inner drive or mandrel section 161 of the bit, between the positions shown in FIGS. 10*b* and 10*c*, in which the cutter arms 16 are retracted, and in FIGS. 15*a* and 15*b*, in which the cutter arms 16 are expanded.

The outer, cutter arms supporting structure 160 comprises a tubular member 162 having at circumferentially spaced locations elongated fluid passages or slots 163 milled therein and then closed by elongated closure strips 164 welded into an elongated seat 165. At alternate angularly spaced locations about the member 162 are additional passage ways are slots 166 which are somewhat shorter than the slots 163 and which are closed by elongated closure strips 167 welded in seats 167′ in the member 162. As will be described hereinafter, the passage ways 163 are adapted to supply air to the cutters C on the cutter arms 16, and the passages 166 communicate with passages 168 in the lower end section 169 of the outer body member 162, these passages 168 leading to nozzles 170 which are carried in the lower end of the body and are directed towards the bits' cutters, whereby the air discharging from the nozzles is caused to blow over the cutters to remove cuttings therefrom and assist in maintaining the bit in a cool operating condition.

Carried by the lower end section 169 of the body member 162 in a plurality of circumferentially spaced elongated slots 171 are the respective cutter support arms 16. Pivot pins 172 extend through the upper ends 173 of the cutter arms 16 and into aligned bores 174 at opposite sides of the slots. The pins engage at one end with a stop 175 and are retained in place by suitable screw members 176 threaded into the body as seen in FIG. 14.

As previously indicated, air from passages 163 in the body member 162 is adapted to be directed to the cutters C. Thus, the passages 163, at the lower ends, open into a bore 177, and a flexible, preferably metallic, fluid connector 178 has a fitting 179 connected in the bore 177 and another fitting 180 which communicates with an elongated passage 181 formed in the bit support arm 16. In the illustrated embodiment, the bit arm 16 is a two part structure, including the pivot end 16*a* and the cutter support end 16*b* joined together by a weld 16*c* with a tubular insert 16*d* providing for continuity of the fluid passage 181. Air supplied to the passages 181 is adapted to cool the cutters C in a manner to be described below.

The inner body or drive member 161 extends reciprocably within the outer member 162 and has at its lower end a tubular member 182 having a head 183 disposed in a seat 184 at the lower end of the body member 161 and retained in place by a suitable means such as a split retainer ring 185, which is in turn retained in place by balls 186 engaging in opposed arcuate surfaces provided about the outer periphery of the split ring 185 and about the inner peripheral wall of the seat 184. The tubular member 182 extends downwardly within the center of the outer body section 162 and through a bushing 187, which is retained in place by snap rings 188 within a bore 189 provided in a web 190 at the lower end of the outer body member 169. Extending through the tubular member 182 is a fluid passage 191 which is in communication with the central passage 154 through the inner bit body member 161. Since the air flowing through the tubular member 182 is laden with cuttings and abrasive dust, the member 182 is preferably provided at its lower end with a wear resistant ring insert 192.

In the operation of the structure to expand the cutter supporting arms outwardly from the position of FIG. 10*c* to the position of FIG. 15*b*, an outward projection 193 at one side of the tubular member 182 is formed to engage a downwardly and inwardly, arcuatly extended camming surface 194 provided on the inside of the respective support arms 16. At the lower end of the camming surface 194 is a locking surface 195 which, when the arm 16 is fully pivotally extended as seen in FIG. 15*b* is engaged by the cam member 193 to mechanically lock the arms in the expanded positions until reverse motion of the bit body members occurs. Upon such reverse motion of the bit body sections, a shoulder 196 projecting outwardly and facing upwardly on the tubular member 182 is provided for engagement with a downwardly facing lug or projection 197 upon the upper end 173 of the respective support arm 16, whereby to pivotally shift the support arms 16 from the extended position of FIG. 15*b* back to the retracted position of FIG. 10*c*, enabling the bit structure to be removed from the hole on the drill pipe.

As previously indicated, the inner bit body member 161 is a rotary drive member which is adapted to rotatably drive the outer bit body section 162 in response to rotation of the drill pipe string, so that the bit cutters are rotated or revolved about the axis of the bit. The rotary drive between the bit body sections is provided as shown in FIG. 13, wherein it will be seen that at opposite sides of the inner body section 161 are chordal flats 198 disposed in opposed relation and slidably engageable with segmental torque transmitting members 199, which are carried within the outer body member 162 and suitably fixed in place as by weldments.

As previously indicated, the piston and cylinder means 159 which form the piston chamber 158 act to move the outer body structure 160 upwardly with respect to the inner body structure 161 when the cutter arms 16 are to be extended. Referring to FIG. 10*b*, it will be noted that the piston and cylinder structure comprises an upper annular head 200 secured within the upper end of the outer body member 162 by means such as retainer screws 201 carried by the body member 162 and extending into an opening or groove 202 formed about the outer periphery of the head 200. An external sealing ring 203 is disposed between the body member 162 and the outer periphery of the head 200, and an internal side ring seal or piston ring 203' is carried by the head and slidably and sealingly engaged with the outer cylindrical surface of the upper and outer body member 156. Another wiper or resilient seal 204 is carried by the upper end of the head 200 and slidably engages the cylindrical outer surface of the body member 156. In addition, a lubricant is adapted to be supplied to an annular space 205 above the piston ring seal 203' and the wiper ring seal 204 through a suitable grease fitting 206 to lubricate the slidable connection between the head 200 and the body member 156. Below the head 200, and carried by the inner body member 161, is another head member or ring 207 disposed about the outer periphery of the body member 161 and seating on a stop ring 208, the ring being held in place by means of a number of circumferentially spaced retainer screws 209 threaded into the inner body member 161. A static seal ring 210 is disposed between the body member 161 and the inner periphery of the head 207, and a sliding and resilient ring seal 211 is carried by the head ring 207 adjacent its lower end and slidably and sealingly engaging within the inner cylindrical surface of the outer body member 162. Another external ring seal 212 is carried by the head ring 207 and slidably engages the inner periphery of the outer body member 162 at the upper end of the head ring 207. Thus, it will be seen that air supplied through the swivel to the annular space A between the inner and outer pipe sections can flow downwardly through the respective joints finding access to the air passages 155 provided in the bit mandrel. Ports 157 at the lower end of the passages 155 provide communication between the passages 155 and the piston chamber 158, so that the pressure of air in the piston chamber acts upwardly across the annular cross-sectional area of the head 200 between the outer periphery of the bit mandrel 156 and the inner periphery of the outer bit member 162, providing an upward force to lift the outer body member 162 and consequently the bit support arms 16 upwardly with respect to the inner body member 161 and the caming member 193 on the mandrel tube 182. Such upward movement causes the progressive expansion of the bit arms 16 outwardly, as rotation of the drill pipe causes the cutter C to form the downwardly facing upper shoulder within the enlarged bore hole EH.

A suitable number of circumferentially spaced small ports 213 communicate between the piston chamber 158 immediately below the head 200 and the air passages 163 in the outer body member 162, whereby a portion of the air supplied to the piston chamber finds access to the passages 163, and then through the flexible connectors 178 to the air passages 181 in the bit arm 16.

Referring to FIG. 11, it will be seen that the cutter arm passages 181 are adapted to supply air to the cutters C to cool the same. The passages 181 communicate via passage 181*a* with a bore 181*b*, and from the bore 181*b* air can flow through a further passage 181*c*, which extends through the journal or mount 220 for the rotary conical cutter element 221, which carries suitable hard cutting inserts 222 arranged in an appropriate cutting pattern, as is well known. Between the journal or hub 220 of the cutter and the conical cutter element 221 are suitable roller bearings 223 engaging opposed parallel bearings surfaces 224 within the conical member 225 on the hub. In addition, ball bearing elements 226 are disposed between opposed arcuate seats 227 on the hub and 228 within the conical cutter element 221, these balls being supplied initially through the bore 181*b* and serving to rotatably retain the cutter element 221 on the hub. After the bearing balls 226 are installed, they are retained in place by a retainer 229 disposed in the bore 181*b* and providing an inner arcuate surface 230 corresponding to the surface 227 within the journal, and retainer 229 is then secured in place as by a weld 231. In addition, an end bearing or sleeve 232 is disposed between the reduced end of the journal 220 and the end bore within the conical member 221. The air passage 181*c* opens through the inner end of the journal 220, so that all of the air supplied through the passage 181 passes about the bearings 232, 226 and 223 as the air exits between the cutter cone and the journal.

While, as previously indicated, the relatively small ports 213 leading from the piston chamber 158 to the fluid passages 163 and thence to the cutters allow sufficient flow to effectively cool the cutters during the initial hole opening operation, it is desired that after expansion of the cutters to the positions of FIG. 15*b*, where they are mechanically locked in the outwardly extended position, a larger volume of air be supplied to the cutters to cool them. Accordingly, again referring to FIG. 10*b*, it will be seen that additional fluid ports 213*a* are provided in the body member 162 and communicating with the air passages 163 therein. These ports 213*a* are initially closed by virtue of the lower side ring seal 211 and the upper side ring seal 212 between the head member or sleeve 207 and the inner periphery of the body member 162. However, as the body member 162 moves upwardly, to the position of FIG. 15*a*, it will be seen that the relatively larger ports 213*a* communicate with the piston chamber 158 after the ports 213*a* pass above the upper head seal 212, whereby additional air is supplied to the passage ways through the cutter supporting arms and to the cutters.

In addition, it will be seen, again referring to FIG. 10*b*, that the body member 162 has additional circumferentially spaced ports communicating with the passageways 166 extending therethrough and leading to the nozzles 170 at the lower end of the outer bit body section 169. These additional ports 213*b* are also initially located between the lower seal 211 and the upper seal 212 between the body 162 and the head ring 207, so that communication between these ports 213b and the fluid passage 155 is initially precluded. Here again, however, as the outer body of the bit moves upwardly and the bit arms 16 are fully expanded, these additional ports 213b are also in communication with the piston chamber 158 so that a share of the air supplied to the piston chamber can now flow to the nozzles which are, as seen in FIG. 16, directed towards the cutters C so as to create an air blast against the cutters to blow cuttings therefrom and also assist in maintaining the cutters cool.

In the use of the apparatus described above to first form a pilot hole PH as in FIG. 1 and to form the enlarged bore hole EH, the components of the apparatus are preferably carried by a drilling rig having a compressor for supplying air to the drilling operation, suitable supports for the various components so that they can be made up in a string during the drilling operations, and engaging and holding tools for the respective components so that they can be torqued together. Initially, the crossover sub CO is made up together with the usual drilling bit B and the swivel S, together with an appropriate length of intermediate dual concentric pipe. Rotation is applied to the pipe string as the drilling air is supplied to the conduit 10. The air flows down the annulus A of the pipe string, crossing over through the crossover to the central bit passage and returns to the surface through the annulus 15 outside of the drill pipe. This is, except for the use of the dual concentric pipe and crossover, a fairly standard bore hole drilling operation which could be conducted with ordinary drill pipe instead of the dual concentric pipe. After the pilot hole PH as been drilled to the desired depth, the drilling string is removed from the bore hole and the bit and crossover assembly removed. Then the expansible bit EB is applied to the pipe string and lowered in the bore hole to the location at which the formation of the enlarged chamber or hole EH is to commence.

Air is supplied simultaneously to the drilling fluid conduit 10 as well as to the venturi V, and rotation of the drill pipe string is effected to commence the cutting action of the cutter C against the pilot hole wall. The cuttings, together with the portion of the air circulated to the cutter C through the expansible arms will reversely flow upwardly through the center pipe assisted by the induced flow produced by the venturi device V. Since the flow of drilling air to the cutter C is initially restricted by the relatively small ports 213 communicating between the cutter expanding piston chamber 158 and the cutters, high air pressure is available to forcefully move the cutters outwardly to rapidly undercut the formation, preventing the outer surfaces of the cutter arm 16 from dragging on the formation at the undercut shoulder. When the expansible cutters are fully expanded and locked in place by the camming action of the mandrel on the support arms and more air is allowed to circulate through the cutters to cool and cleanse them, the balance of the air is jetted through the nozzles 170 in the direction of the bits to further blow the bits clean and further cool them. The drilling operation can then be continued until, for example, the enlarged hole is drilled to the same depth as the depth of the original pilot hole, as in the two pass blast hole forming method of the above-identified copending application. Then the circulation of air through the drill pipe and the application of drilling thrust can be ceased, while the application of air to the venturi continues. Any cuttings and dust which have been carried upwardly through the bore hole annulus in the air which returns to the surface through the annulus will then settle to the bottom of the bore hole. The continued rotation of the drill pipe can cause the cutters to agitate the settling dust and cuttings, and the flow of air downwardly through the annulus and upwardly through the center of the drill pipe, under the influence of the venturi will vacuum the hole relatively clean.

I claim:

1. The method of drilling enlarged bore holes in earth formation comprising: drilling a pilot hole into the earth formation by rotating a pilot bit on a dual pipe string having an outer fluid path defined between inner and outer pipes, while circulating drilling fluid through the bit causing drilling fluid and cuttings to flow from the pilot hole through the space between the pipe string and the bore hole wall; halting the circulation of drilling fluid and removing the pipe string and pilot bit from the bore hole; replacing the pilot bit with a bore hole enlarging bit having cutters expansible to a gauge in excess of the gauge of the pilot bit; moving the enlarging bit on the drill pipe to a selected location in the pilot hole spaced from the bottom of the pilot hole; expanding said enlarging bit cutters by supplying drilling fluid through said outer fluid path of said drill pipe to said enlarging bit; rotating said drill pipe and enlarging bit to drill an enlarged bore hole toward the bottom of said pilot hole while removing a portion of the drilling fluid and cuttings of earth formation through an inner fluid path defined by said inner pipe; ceasing the supply of drilling fluid; retracting the enlarging bit cutters; and removing said drill pipe and enlarging bit from the enlarged bore hole.

2. The method of claim 1; including enlarging said bore hole a distance substantially coterminus with said pilot hole.

3. The method of claim 1; including inducing the flow of drilling fluid from the bore hole through said inner fluid path.

4. The method of claim 1; including inducing the flow of drilling fluid from the bore hole through said inner fluid path by reducing the pressure in said inner fluid path.

5. The method of claim 1; including inducing the flow of drilling from the bore hole through said inner fluid path by reducing the pressure in said inner fluid path with a venturi.

6. The method of claim 1; including inducing the flow of drilling fluid from the bore hole through said inner fluid path, and continuing to induce flow of fluid and cuttings from said inner fluid path after cessation of the supply of drilling fluid and before retraction of said cutters of said enlarging bit to vacuum clean the bore hole.

7. The method of claim 1; including restricting the flow of drilling fluid from said outer fluid path through said cutters while expanding said cutters, and directing a portion of said drilling fluid from said outer fluid path into the bore hole towards said cutters following expansion of said cutters.

8. The method of claim 1; including restricting the flow of drilling fluid from said outer fluid path through said cutters while expanding said cutters, and directing a portion of said drilling fluid from said outer fluid path into the bore hole towards said cutters following expansion of said cutters, including enlarging said bore hole a distance substantially coterminus with said pilot hole.

* * * * *